US008663032B2

(12) United States Patent
Fitchett et al.

(10) Patent No.: US 8,663,032 B2
(45) Date of Patent: Mar. 4, 2014

(54) GOLF BALLS INCLUDING MULTIPLE DIMPLE TYPES AND/OR MULTIPLE LAYERS OF DIFFERENT HARDNESSES

(75) Inventors: Derek A. Fitchett, Beaverton, OR (US); Peter Newbury, Rye, NH (US)

(73) Assignee: Nike, Inc., Beaverton, OR (US)

( * ) Notice: Subject to any disclaimer, the term of this patent is extended or adjusted under 35 U.S.C. 154(b) by 279 days.

(21) Appl. No.: 12/860,329

(22) Filed: Aug. 20, 2010

(65) Prior Publication Data

US 2012/0046132 A1 Feb. 23, 2012

(51) Int. Cl.
*A63B 37/12* (2006.01)
*A63B 37/14* (2006.01)

(52) U.S. Cl.
USPC ..... 473/383; 473/378

(58) Field of Classification Search
None
See application file for complete search history.

(56) References Cited

U.S. PATENT DOCUMENTS

| | | | | |
|---|---|---|---|---|
| 4,744,564 | A | 5/1988 | Yamada | |
| 5,009,428 | A | 4/1991 | Yamagishi et al. | |
| 5,156,404 | A * | 10/1992 | Oka et al. | 473/382 |
| 5,482,287 | A | 1/1996 | Nesbitt et al. | |
| 5,782,703 | A * | 7/1998 | Yamagishi et al. | 473/280 |
| 6,066,055 | A | 5/2000 | Nishino | |
| 6,071,201 | A | 6/2000 | Maruko | |
| 7,179,178 | B2 | 2/2007 | Veilleux et al. | |
| 7,749,107 | B2 | 7/2010 | Sullivan et al. | |
| 2001/0003105 | A1 * | 6/2001 | Sullivan | 473/384 |
| 2003/0119606 | A1 | 6/2003 | Ohama | |
| 2003/0125137 | A1 * | 7/2003 | Shannon et al. | 473/383 |
| 2003/0134695 | A1 | 7/2003 | Kasashima | |
| 2004/0106467 | A1 * | 6/2004 | Ogg | 473/351 |
| 2005/0032590 | A1 * | 2/2005 | Kasashima et al. | 473/378 |
| 2006/0019772 | A1 | 1/2006 | Sullivan | |
| 2007/0281802 | A1 | 12/2007 | Watanabe et al. | |
| 2009/0124414 | A1 | 5/2009 | Sullivan | |

(Continued)

FOREIGN PATENT DOCUMENTS

| | | |
|---|---|---|
| JP | 61-284264 | 12/1986 |
| JP | 4-109968 | 4/1992 |

(Continued)

OTHER PUBLICATIONS

Firoz Alam et al., A Study of Golf Ball Aerodynamic Drag, Science Direct, Procedia Engineering 13 (2011), pp. 226-231, 2011, Elsevier Ltd.

(Continued)

*Primary Examiner* — Gene Kim
*Assistant Examiner* — John E Simms, Jr.
(74) *Attorney, Agent, or Firm* — Banner & Witcoff, Ltd.

(57) ABSTRACT

Golf balls may include a first pole, a second pole, and a seam located between the first and second poles. Dimples are formed on a surface of the ball in a pattern that includes a plurality of repeating sectors around each pole of the ball. The sectors on one ball half are rotationally offset across the seam line from the sectors on the other ball half. Additionally, each individual sector includes a line of symmetry over which the dimple pattern on one half of the sector is mirrored on the other half. A variety of different dimple types also may be arranged on a golf ball surface, e.g., within the sectors described above. Additional aspects of this invention relate to the features of various layers of a multi-piece golf ball and to methods of making golf balls having at least some of the features mentioned above.

44 Claims, 12 Drawing Sheets

(56) References Cited

U.S. PATENT DOCUMENTS

| | | | | |
|---|---|---|---|---|
| 2009/0124425 | A1 | 5/2009 | Sullivan et al. | |
| 2009/0191982 | A1 * | 7/2009 | Kim et al. | 473/378 |
| 2009/0209368 | A1 | 8/2009 | Kasashima et al. | |
| 2010/0075778 | A1 | 3/2010 | Kamino | |
| 2010/0081518 | A1 | 4/2010 | Sullivan | |
| 2010/0093466 | A1 | 4/2010 | Ohama et al. | |
| 2010/0190581 | A1 | 7/2010 | Sato et al. | |
| 2010/0190584 | A1 | 7/2010 | Sajima | |

FOREIGN PATENT DOCUMENTS

| | | | |
|---|---|---|---|
| JP | 10-328326 | | 12/1998 |
| JP | 11-137721 | A | 5/1999 |
| JP | 2000-093556 | | 4/2000 |
| JP | 2000-229133 | A | 8/2000 |
| JP | 2000-350795 | A | 12/2000 |
| JP | 2003-190326 | | 7/2003 |
| JP | 2007-195591 | A | 8/2007 |
| JP | 2007319667 | A | 12/2007 |
| JP | 2009-095369 | | 5/2009 |
| JP | 2010088797 | A | 4/2010 |
| KR | 100219992 | B1 | 9/1999 |
| KR | 10074452 | B1 | 8/2007 |
| WO | 2009108887 | | 9/2009 |

OTHER PUBLICATIONS

C.E. Smith et al., Numerical Investigation of the Flow Over a Golf Ball in the Subcritical and Supercritical Regimens, International Journal of Heat and Fluid Flow 31 (2010, pp. 262-273, 2010, Elsevier Ltd.

Office Action from Chinese SN 201110238299.0, dated Sep. 2, 2013.

Office Action from EP SN 11177947.6, dated Dec. 21, 2011.

Office Action from Canadian SN 2,747,405, dated Dec. 21, 2011.

Office Action from Chinese SN 201110228896.5, dated Aug. 29, 2013.

Office Action from Canadian SN 2,747,405, dated Jun. 8, 2012.

Office Action from Japanese SN 2011-172663, dated Oct. 2, 2012.

Office Action from Chinese SN 201110232013.8, dated Sep. 18, 2013.

* cited by examiner

GOLF BALLS INCLUDING MULTIPLE DIMPLE TYPES AND/OR MULTIPLE LAYERS OF DIFFERENT HARDNESSES

FIELD OF THE INVENTION

The invention relates generally to golf balls, including golf balls having multiple different types of dimples and/or multiple layers of different materials and/or hardnesses.

BACKGROUND

Golf is enjoyed by a wide variety of players—players of different genders and players of dramatically different ages and skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with increased availability of golf programming on television (e.g., golf tournaments, golf news, golf history, and/or other golf programming) and the rise of well known golf superstars, at least in part, have increased golf's popularity in recent years both in the United States and across the world.

In the game of golf, golf balls are propelled in a variety of different manners (e.g., to travel long or maximum distances; to travel shorter, controlled distances; for chipping or pitching; for putting; etc.), and different physical properties or characteristics of the ball will better assist in performing the ball's desired functions. Unfortunately, many of the desired functions of the ball require contrasting physical properties or characteristics. For example, certain hardness and spin characteristics are useful to enable a golf ball to fly long distances when struck at high swing speeds, e.g., by a driver. These same hardness and spin characteristics, however, are less desirable for more delicate shots, like iron shots, pitch shots, and chip shots closer to the green, where more precise distance control and consistent ball reactions upon contact with the ground are desired.

As another example, personal "feel" or comfort in using a ball can be important for players. Balls of different hardnesses and/or made from different materials may react differently when struck with different clubs (e.g., produce a different hardness "feel," produce different sounds, etc.). A ball formed to travel long or maximum distances off the driver may feel too hard and/or produce an undesirable sound (e.g., a loud click or ping) for the preferences of at least some players. A softer ball that induces more spin (and generally travels a shorter distance) also may produce an undesirable sound for the preferences of some players (e.g., it may produce more of a "thud" type sound when struck by club), and it may not travel the desired distances on longer shots. Accordingly, selecting a ball may require players to balance their performance and "feel" requirements and desires. Ball construction and feel characteristics are definitely not a "one-size-fits-all" proposition.

Golf ball's dimple patterns also are not a "one-size-fits-all" situation. For example, players with lower swing speeds may need a dimple pattern that helps the ball get better lift when struck by the driver to enable this player to achieve better driving distance. This same dimple pattern, however, if used by a player having a high swing speed, may cause the ball to "balloon" during its initial flight, resulting in decreased distance off the driver. On the other hand, dimple patterns that are useful to control ball trajectory and provide optimal distance at higher swing speeds (e.g., off the driver) may cause the ball to fly shorter distances when struck by drivers at lower swing speeds.

While technological improvements to golf balls have been made in recent years, additional golf ball options for affecting ball flight, ball feel, and ball performance would be welcome in the art.

SUMMARY

The following presents a general summary of aspects of the invention in order to provide a basic understanding of this invention. This summary is not intended as an extensive overview of the invention. It is not intended to identify key or critical elements of the invention or to delineate the scope of the invention. The following summary merely presents some concepts of the invention in a general form as a prelude to the more detailed description provided below.

In general, aspects of this invention relate to golf balls. Golf balls according to at least some examples of this invention may include one or more of the following: (a) a first pole, (b) a second pole, and (c) a seam or equator located between the first and second poles. A plurality of dimples are formed on a surface of the ball, wherein the plurality of dimples are arranged in a pattern that includes:

(a) a first dimple pattern half including N sectors, wherein N is an integer ranging from 2 to 10, wherein a first dimple pattern sector is arranged in each of the N sectors of the first dimple pattern half such that a line of symmetry extending in a direction from the first pole to the seam exists within each of the N sectors of the first dimple pattern half, and wherein the first dimple pattern sector is repeated N times around the first pole, and (b) a second dimple pattern half including N sectors, wherein the first dimple pattern sector is arranged in each of the N sectors of the second dimple pattern half such that a line of symmetry extending in a direction from the second pole to the seam exists within each of the N sectors of the second dimple pattern half, wherein the first dimple pattern sector is repeated N times around the second pole, and wherein the lines of symmetry in the first dimple pattern half do not align with and are rotationally offset from the lines of symmetry of the second dimple pattern half, e.g., by an offset amount within a range of 2° to 90° (and in some examples, within the range of 5° to 60° or even from 5° to 45°). In some balls, the rotational offset will be within the range of 2° to (360/2N)°, where N is the number of sectors in each dimple pattern half having a line of symmetry (if desired, a ball may include one or more sectors without lines of symmetry).

Such golf balls may include: (a) a first dimple type having a first diameter; (b) a second dimple type having a second diameter that is larger than the first diameter; (c) a third dimple type having a third diameter that is larger than the second diameter; (d) a fourth dimple type having a fourth diameter that is larger than the third diameter; (e) a fifth dimple type having a fifth diameter that is larger than the fourth diameter; and, optionally, (f) at least a sixth dimple type having a sixth diameter that is larger than the fifth diameter.

Golf balls according to another example aspect of this invention may include: (a) a first pole, (b) a second pole, and (c) a seam located between the first and second poles. A plurality of dimples are formed on the surface of this ball, wherein the dimples include: (i) a first dimple type having a first diameter; (ii) a second dimple type having the first diameter, wherein the second dimple type is deeper than the first dimple type, and wherein a majority of dimples of the second dimple type are located further from the seam than a majority of dimples of the first dimple type; (iii) a third dimple type having a second diameter that is larger than the first diameter; (iv) a fourth dimple type having the second diameter, wherein the fourth dimple type is deeper than the third dimple type, and wherein a majority of dimples of the fourth dimple type are located further from the seam than a majority of dimples of the third dimple type; (v) a fifth dimple type having a third diameter that is larger than the second diameter; (vi) a sixth dimple type having a fourth diameter that is larger than the third diameter; (vii) a seventh dimple type having a fifth diameter that is larger than the fourth diameter; (viii) an eighth dimple type having the fifth diameter, wherein the eighth dimple type is deeper than the seventh dimple type, and wherein a majority of dimples of the eighth dimple type are located further from the seam than a majority of dimples of the seventh dimple type; (ix) a ninth dimple type having a sixth diameter that is larger than the fifth diameter; and (x) a tenth dimple type having the sixth diameter, wherein the tenth dimple type is deeper than the ninth dimple type, and wherein a majority of dimples of the tenth dimple type are located further from the seam than a majority of dimples of the ninth dimple type.

As additional potential features of this example golf ball structure, the first dimple type may have a depth of at least 0.175 mm and/or the second dimple type may have a depth of at least 0.185 mm. Additionally or alternatively, dimples of the first dimple type may have a diameter-to-depth ratio of 15 or less and/or dimples of the second dimple type may have a diameter-to-depth ratio of 14 or less. As another alternative, if desired, dimples of each of the first and second dimple types may have a diameter-to-depth ratio of 14 or less while dimples of each of the third through tenth dimple types may have a diameter-to-depth ratio of 16 or more (and, if desired, at least some of the third through tenth dimple types may have a diameter-to-depth ratio of 20 or more). As additional potential examples, dimples of each of the first and second dimple types may have a dimple radius of 5 mm or less while dimples of each of the third through tenth dimple types may have a dimple radius of 8 mm or more (and, if desired, at least some of the third through tenth dimple types may have a dimple radius of 10 mm or more).

Additional example aspects of this invention include golf balls having a surface with plural dimples formed therein, wherein the dimples are arranged in a pattern that includes: (a) a first sector comprised of a first spherical triangular region on the surface, wherein the first spherical triangular region is divided into a first half and a second half, wherein a plurality of dimples are arranged in the first sector such that the dimple locations in the first half of the first sector mirror the dimple locations in the second half of the first sector; (b) a second sector comprised of a second spherical triangular region on the surface, wherein the second spherical triangular region is divided into a first half and a second half, wherein a plurality of dimples are arranged in the second sector such that the dimple locations in the first half of the second sector mirror the dimple locations in the second half of the second sector; (c) a third sector comprised of a third spherical triangular region on the surface, wherein the third spherical triangular region is divided into a first half and a second half, wherein a plurality of dimples are arranged in the third sector such that the dimple locations in the first half of the third sector mirror the dimple locations in the second half of the third sector; and (d) a fourth sector comprised of a fourth spherical triangular region on the surface, wherein the fourth spherical triangular region is divided into a first half and a second half, wherein a plurality of dimples are arranged in the fourth sector such that the dimple locations in the first half of the fourth sector mirror the dimple locations in the second half of the fourth sector. Some of the sectors may share at least one common point and/or the dimple patterns within at least some of the sectors may be the same.

Additional aspects of this invention relate to the constructional and/or layer features of multi-piece golf balls. Such multi-piece golf balls, according to at least some examples of this invention, may include: (a) a core made from one or more pieces, the core having an outermost surface hardness within a range of 53 to 61 Shore D, wherein the core has a diameter within a range of 18 to 40 mm; (b) a mantle layer surrounding and immediately adjacent the outermost surface of the core, the mantle layer including a thermoplastic polyurethane containing material, the mantle layer having a surface hardness within a range of 64 to 72 Shore D, wherein the mantle layer has a thickness within a range of 0.4 to 1.6 mm; and (c) a cover layer surrounding the mantle layer, the cover layer including a thermoplastic polyurethane containing material, the cover layer having a surface hardness within a range of 50 to 58 Shore D, and the cover layer having a nominal thickness within a range of 0.6 to 1.6 mm. The Shore D hardness of the mantle layer may be higher than the Shore D outermost surface hardness of the core and the Shore D surface hardness of the cover layer. Balls of this construction may have any desired dimple features, including the dimple sizes, patterns, and arrangements described above (and those described in more detail below).

Other ball constructions are possible in accordance with at least some examples of this invention. As some more specific examples, multi-piece golf balls in accordance with at least some examples of this invention may include: (a) a solid inner core including a thermoplastic resin material (e.g., an ionomeric material), the solid inner core having a surface hardness within a range of 42 to 54 Shore D, wherein the solid inner core has a diameter within a range of 18 to 36 mm; (b) an outer core layer surrounding the solid inner core, the outer core layer including a polybutadiene rubber containing material or a thermoplastic resin containing material (e.g., an ionomeric material), the outer core layer having a surface hardness within a range of 50 to 64 Shore D, wherein the outer core layer has a thickness within a range of 4 to 10 mm; (c) a mantle layer surrounding the outer core layer, the mantle layer including a thermoplastic polyurethane containing material, the mantle layer having a surface hardness within a range of 60 to 72 Shore D, wherein the mantle layer has a thickness within a range of 0.4 to 1.6 mm; and (d) a cover layer surrounding the mantle layer, the cover layer including a thermoplastic polyurethane containing material, the cover layer having a surface hardness within a range of 44 to 60 Shore D, wherein the cover layer has a nominal thickness within a range of 0.6 to 1.6 mm. In such balls, the Shore D surface hardness of the mantle layer may be higher than the Shore D surface hardnesses of the solid inner core, the outer core layer, and the cover layer. Optionally, balls in accordance with some examples of this invention may include still additional layers, such as another layer between the mantle layer and the outer core layer and/or another layer between the mantle layer and the cover layer. Balls of this construction may have any desired dimple features, including the dimple sizes, patterns, and arrangements described above (and those described in more detail below).

Additional aspects of this invention relate to methods for making golf balls, e.g., such as golf balls having the dimple features and/or construction or layer features as described above (as well as the features described in more detail below). Such methods will be described in more detail below.

BRIEF DESCRIPTION OF THE DRAWINGS

A more complete understanding of the present invention and certain advantages thereof may be acquired by referring to the following detailed description in consideration with the accompanying drawings, in which the same reference numbers indicate the same or similar features, and wherein.

DETAILED DESCRIPTION

Figure 1A:
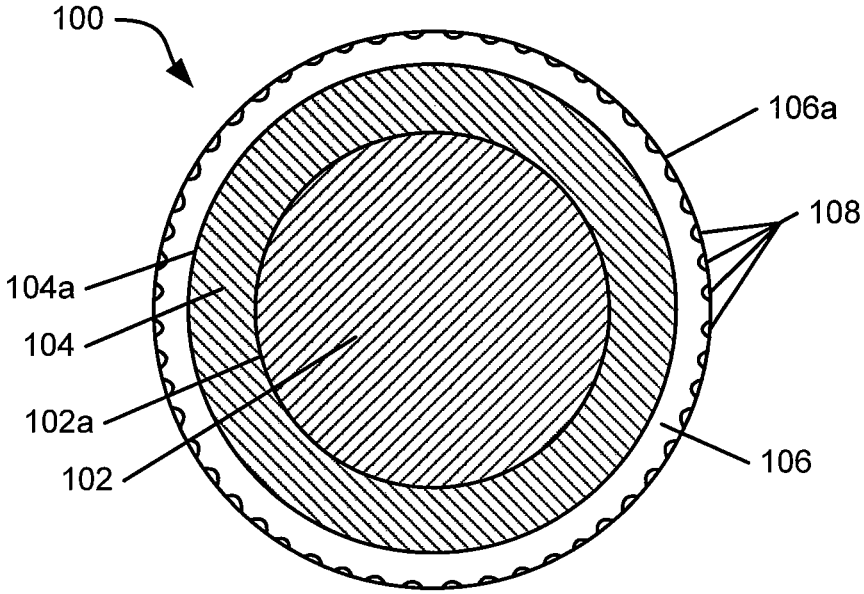
FIGS. 1A through 1D illustrate various example multi-piece golf ball constructions that may be used in accordance with at least some example aspects of this invention.

In the following description of various example golf balls and other aspects of this invention, reference is made to the accompanying drawings, which form a part hereof, and in which are shown by way of illustration various example golf ball structures and golf ball formation steps in which aspects of the invention may be practiced. It is to be understood that other specific arrangements of parts, structures, and steps may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures and/or the orientations during typical use. Nothing in this specification should be construed as requiring a specific three dimensional orientation of structures in order to fall within the scope of this invention.

The term "seam," as it is used in this specification, corresponds to a location on the ball where two halves of a mold for forming the golf ball cover meet. The "seam" may or may not correspond to a great circle that extends around the golf ball equator. For golf balls having covers or dimples made by processes that do not include joining two mold halves together at a seam, the "seam" corresponds to any great circle location on the ball that separates two equivalent dimple pattern halves (the dimple pattern halves may be rotationally offset from one another on the ball), such as the ball's equator.

At least some example aspects of this invention relate to golf balls, as well as to methods of making the balls. A general description of aspects of the invention followed by a more detailed description of specific examples of the invention follows.

A. General Description of Golf Balls According to Aspects of the Invention

1. Dimple Aspects

In general, aspects of this invention relate to golf balls. Golf balls according to at least some examples of this invention may include one or more of the following: (a) a first pole, (b) a second pole, and (c) a seam located between the first and second poles (the seam may be a continuous circle corresponding to the equator of the ball, a waveform (e.g., centered on the ball's equator), stepped line segments, etc.). A plurality of dimples are formed on a surface of the ball, wherein the plurality of dimples are arranged in a pattern that includes:

(a) a first dimple pattern half including N sectors, wherein N is an integer ranging from 2 to 10, wherein a first dimple pattern sector is arranged in each of the N sectors of the first dimple pattern half such that a line of symmetry extending in a direction from the first pole to the seam exists within each of the N sectors of the first dimple pattern half, and wherein the first dimple pattern sector is repeated N times around the first pole, and (b) a second dimple pattern half including N sectors, wherein the first dimple pattern sector is arranged in each of the N sectors of the second dimple pattern half such that a line of symmetry extending in a direction from the second pole to the seam exists within each of the N sectors of the second dimple pattern half, wherein the first dimple pattern sector is repeated N times around the second pole, and wherein the lines of symmetry in the first dimple pattern half do not align with and are rotationally offset from the lines of symmetry of the second dimple pattern half, e.g., by an offset amount within a range of 2° to 90°, and in some examples, within a range from 5° to 60° or even from 5° to 45°.

In some example structures in accordance with this invention, the offset amount will be within a range of 10° to 45°, 10° to 30°, or even 15° to 30°. In some balls, the rotational offset amount will be within the range of 2° to (360/2N)°, where N is the number of sectors in each dimple pattern half having a line of symmetry. Additionally, in some specific examples of this invention, the integer "N" representing the number of sectors in each dimple pattern half having a line of symmetry will range from 2 to 8 or even from 3 to 6. If desired, each dimple pattern half may contain one or more sectors that do not include lines of symmetry (e.g., interspersed between the N sectors that have lines of symmetry).

Golf balls in accordance with examples of this invention may have any desired number of dimples, including, for example, from 320 to 432 total dimples, and in some examples, from 330 to 392 total dimples. The dimples in golf ball structures in accordance with examples of this invention as described above further may be sized so as to include at least four different dimple types, and in some examples, from 4 to 16 different dimple types, or even from 5 to 12 different dimple types. As will be explained in more detail below, a dimple is of a different "type" from another dimple if it differs from the other dimple in any significant manner, such as in at least one of dimple depth, dimple radius, dimple diameter, dimple cross sectional shape (e.g., single radius, double radii, polygonal shape, faceted internal surfaces, etc.), dimple volume, dimple surface area, etc.

As some more specific examples, golf balls in accordance with at least some examples of this invention may include: (a) a first dimple type having a first diameter (e.g., within a range of 2 to 3 mm); (b) a second dimple type having a second diameter (e.g., within a range of 3 to 3.6 mm) that is larger than the first diameter; (c) a third dimple type having a third diameter (e.g., within a range of 3.2 to 3.8 mm) that is larger than the second diameter; (d) a fourth dimple type having a fourth diameter (e.g., within a range of 3.4 to 4 mm) that is larger than the third diameter; and (e) a fifth dimple type having a fifth diameter (e.g., within a range of 3.6 to 4.4 mm) that is larger than the fourth diameter. Additionally, more dimple types may be provided in the dimple pattern, including at least a sixth dimple type having a sixth diameter (e.g., within a range of 4 to 6 mm) that is larger than the fifth diameter. In some example balls according to this invention where five dimple types are present, these example balls may include: at least 36 dimples of the first dimple type; at least 24 dimples of the second dimple type; at least 54 dimples of the third dimple type; at least 30 dimples of the fourth dimple type; and at least 246 dimples of the fifth dimple type. In some example balls according to this invention where six dimple types are present, the balls may include: at least 18 dimples of the first dimple type; at least 12 dimples of the second dimple type; at least 6 dimples of the third dimple type; at least 36 dimples of the fourth dimple type; at least 270 dimples of the fifth dimple type; and at least 18 dimples of the sixth dimple type.

In some example golf ball structures in accordance with this invention, the plurality of dimples on the golf ball surface includes: (a) a first dimple type having a first depth, a first radius, and a first diameter; (b) a second dimple type having a second depth, a second radius, and the first diameter; (c) a third dimple type having a third depth, a third radius, and a second diameter; (d) a fourth dimple type having a fourth depth, a fourth radius, and the second diameter; (e) a fifth dimple type having a fifth depth, a fifth radius, and a third diameter; (f) a sixth dimple type having the fifth depth, a sixth radius, and a fourth diameter; (g) a seventh dimple type having a sixth depth, a seventh radius, and a fifth diameter; (h) an eighth dimple type having a seventh depth, an eighth radius, and the fifth diameter; (i) a ninth dimple type having the second depth, a ninth radius, and a sixth diameter; and (j) a tenth dimple type having an eighth depth, a tenth radius, and the sixth diameter.

Golf balls according to another example aspect of this invention may include: (a) a first pole, (b) a second pole, and (c) a seam located between the first and second poles (the seam may be a continuous circle at the ball's equator, a waveform (e.g., centered at the ball's equator), stepped line segments, or any other desired shape). A plurality of dimples are formed on the surface of the ball, wherein the dimples include: (i) a first dimple type having a first diameter; (ii) a second dimple type having the first diameter, wherein the second dimple type is deeper than the first dimple type, and wherein a majority of dimples of the second dimple type are located further from the seam than a majority of dimples of the first dimple type; (iii) a third dimple type having a second diameter that is larger than the first diameter; (iv) a fourth dimple type having the second diameter, wherein the fourth dimple type is deeper than the third dimple type, and wherein a majority of dimples of the fourth dimple type are located further from the seam than a majority of dimples of the third dimple type; (v) a fifth dimple type having a third diameter that is larger than the second diameter; (vi) a sixth dimple type having a fourth diameter that is larger than the third diameter; (vii) a seventh dimple type having a fifth diameter that is larger than the fourth diameter; (viii) an eighth dimple type having the fifth diameter, wherein the eighth dimple type is deeper than the seventh dimple type, and wherein a majority of dimples of the eighth dimple type are located further from the seam than a majority of dimples of the seventh dimple type; (ix) a ninth dimple type having a sixth diameter that is larger than the fifth diameter; and (x) a tenth dimple type having the sixth diameter, wherein the tenth dimple type is deeper than the ninth dimple type, and wherein a majority of dimples of the tenth dimple type are located further from the seam than a majority of dimples of the ninth dimple type. If desired, in some example balls, all of the dimples of the second dimple type will be located further from the seam than all of the dimples of the first dimple type; all of the dimples of the fourth dimple type will be located further from the seam than all of the dimples of the third dimple type; all of the dimples of the eighth dimple type will located further from the seam than all of the dimples of the seventh dimple type; and all of the dimples of the tenth dimple type will be located further from the seam than all of the dimples of the ninth dimple type.

In some examples of these golf ball structures, the first diameter will be within a range of 2 to 3 mm; the second diameter will be within a range of 3 to 3.6 mm; the third diameter will be within a range of 3.2 to 3.8 mm; the fourth diameter will be within a range of 3.4 to 4 mm; the fifth diameter will be within a range of 3.6 to 4.4 mm; and the sixth diameter will be within a range of 4 to 6 mm. There may be at least 12 dimples of the first dimple type; at least 6 dimples of the second dimple type; at least 24 dimples of the third dimple type; at least 12 dimples of the fourth dimple type; at least 6 dimples of the fifth dimple type; at least 24 dimples of the sixth dimple type; at least 96 dimples of the seventh dimple type; at least 90 dimples of the eighth dimple type; at least 78 dimples of the ninth dimple type; and at least 12 dimples of the tenth dimple type.

As additional potential features of this example golf ball structure, the first dimple type may have a depth of at least 0.175 mm and/or the second dimple type may have a depth of at least 0.185 mm. Additionally or alternatively, dimples of the first dimple type may have a diameter-to-depth ratio of 15 or less and/or dimples of the second dimple type may have a diameter-to-depth ratio of 14 or less. As another alternative, if desired, dimples of each of the first and second dimple types may have a diameter-to-depth ratio of 14 or less while dimples of each of the third through tenth dimple types may have a diameter-to-depth ratio of 16 or more (and, if desired, at least some of the third through tenth dimple types may have a diameter-to-depth ratio of 20 or more). As additional potential examples, dimples of each of the first and second dimple types may have a dimple radius of 5 mm or less while dimples of each of the third through tenth dimple types may have a dimple radius of 8 mm or more (and, if desired, at least some of the third through tenth dimple types may have a dimple radius of 10 mm or more).

Golf balls in accordance with still additional example aspects of this invention may include a surface having plural dimples formed therein, wherein the dimples are arranged in a pattern that includes: (a) a first sector comprised of a first spherical triangular region on the surface, wherein the first spherical triangular region is divided into a first half and a second half, wherein a plurality of dimples are arranged in the first sector such that the dimple locations in the first half of the first sector mirror the dimple locations in the second half of the first sector; (b) a second sector comprised of a second spherical triangular region on the surface, wherein the second spherical triangular region is divided into a first half and a second half, wherein a plurality of dimples are arranged in the second sector such that the dimple locations in the first half of the second sector mirror the dimple locations in the second half of the second sector; (c) a third sector comprised of a third spherical triangular region on the surface, wherein the third spherical triangular region is divided into a first half and a second half, wherein a plurality of dimples are arranged in the third sector such that the dimple locations in the first half of the third sector mirror the dimple locations in the second half of the third sector; and (d) a fourth sector comprised of a fourth spherical triangular region on the surface, wherein the fourth spherical triangular region is divided into a first half and a second half, wherein a plurality of dimples are arranged in the fourth sector such that the dimple locations in the first half of the fourth sector mirror the dimple locations in the second half of the fourth sector. In some balls in accordance with at least some examples of this invention, the first and second sectors will share at least a first common point (e.g., at one pole of the ball) and/or the third and fourth sectors will share at least a second common point (e.g., at an opposite pole of the ball), wherein the second common point differs from the first common point (e.g., opposite ends of a diameter of the ball). Additionally or alternatively, some balls in accordance with at least some examples of this invention will have a common dimple pattern or arrangement in some or all of the various sectors present on the ball. The golf balls also may have any of the various features noted above (as well as the various features noted below).

Golf balls in accordance with at least some examples of this invention will exhibit an overall dimple volume of at least 320 $mm^3$, and in some examples, at least 360 $mm^3$. In some more specific examples, the overall dimple volume will range from 360 $mm^3$ to 560 $mm^3$ and even from 360 $mm^3$ to 480 $mm^3$ The dimples also may cover any desired proportion of the golf ball's surface area, such as at least 70%, and in some examples, within the range of 72% to 78%. As some more specific examples, golf balls in accordance with at least some examples of this invention will have a ratio $A_d/A_b$ of at least 70%, wherein $A_d$ is a total dimple surface coverage area as determined by Formula (I):

$$A_d = \sum_{n=1}^{M} \pi \times (d_n / 2)^2, \qquad \text{Formula (I)}$$

wherein "M" is a total number of dimples on the golf ball, and "d" is an individual dimple diameter, and wherein $A_b$ is a total golf ball surface area assuming no dimples are present on the ball as determined by Formula (II):

$$A_b = 4\pi \times (D/2)^2 \qquad \text{Formula (II)},$$

wherein "D" is an outermost diameter of the golf ball (measured outside of the dimples).

2. Multi-Piece Ball Construction Aspects

Additional example aspects of this invention relate to the constructional and/or layer features of multi-piece golf balls. Such multi-piece golf balls, according to at least some examples of the invention, may include: (a) a core made from one or more pieces, the core having an outermost surface hardness within a range of 53 to 61 Shore D, wherein the core has a diameter within a range of 18 to 40 mm; (b) a mantle layer surrounding and immediately adjacent the outermost surface of the core, the mantle layer including a thermoplastic polyurethane containing material, the mantle layer having a surface hardness within a range of 64 to 72 Shore D, wherein the mantle layer has a thickness within a range of 0.4 to 1.6 mm; and (c) a cover layer surrounding the mantle layer, the cover layer including a thermoplastic polyurethane containing material, the cover layer having a surface hardness within a range of 50 to 58 Shore D, and the cover layer has a nominal thickness within a range of 0.6 to 1.6 mm. The Shore D hardness of the mantle layer may be higher than the Shore D outermost surface hardness of the core and the Shore D surface hardness of the cover layer.

Other ball constructions are possible in accordance with at least some examples of this invention. As some more specific examples, multi-piece golf balls in accordance with at least some examples of this invention may include: (a) a solid inner core including a thermoplastic resin material (e.g., an ionomeric material), the solid inner core having a surface hardness within a range of 42 to 54 Shore D (and in some examples, from 45 to 51 Shore D or even from 46 to 50 Shore D), wherein the solid inner core has a diameter within a range of 18 to 36 mm; (b) an outer core layer surrounding the solid inner core, the outer core layer including a polybutadiene rubber containing material or a thermoplastic resin containing material (e.g., an ionomeric material), the outer core layer having a surface hardness within a range of 50 to 64 Shore D (and in some examples, from 54 to 60 Shore D or even from 55 to 59 Shore D), wherein the outer core layer has a thickness within a range of 4 to 10 mm; (c) a mantle layer surrounding the outer core layer, the mantle layer including a thermoplastic polyurethane containing material, the mantle layer having a surface hardness within a range of 60 to 72 Shore D (and in some examples, from 64 to 70 Shore D or even from 65 to 69 Shore D), wherein the mantle layer has a thickness within a range of 0.4 to 1.6 mm; and (d) a cover layer surrounding the mantle layer, the cover layer including a thermoplastic polyurethane containing material, the cover layer having a surface hardness within a range of 44 to 60 Shore D (and in some examples, from 50 to 56 Shore D or even from 50 to 54 Shore D), wherein the cover layer has a nominal thickness within a range of 0.6 to 1.6 mm. In such balls, the Shore D surface hardness of the mantle layer may be higher than the Shore D surface hardnesses of the solid inner core, the outer core layer, and the cover layer. Optionally, balls in accordance with some examples of this invention may include still additional layers, such as another layer between the mantle layer and the outer core layer and/or another layer between the mantle layer and the cover layer.

As some more specific examples, if desired, the surface hardness of the mantle layer may be at least 8 Shore D points higher than the surface hardness of the outer core layer, at least 16 Shore D points higher than the surface hardness of the solid inner core, and/or at least 10 Shore D points higher than the surface hardness of the cover layer. Optionally, the Shore D surface hardness of the mantle layer may be higher than any other layer in the ball.

Other more specific examples of such golf ball constructions in accordance with examples of this invention include balls in which the surface hardness of the solid inner core is within a range of 46 to 50 Shore D and the diameter of the solid inner core is within a range of 23 to 26 mm; the surface hardness of the outer core layer within a range of 55 to 59 Shore D and the thickness of the outer core layer is within a range of 6 to 8 mm; the surface hardness of the mantle layer is within a range of 65 to 69 Shore D and the thickness of the mantle layer is within a range of 0.8 to 1.2 mm; and the surface hardness of the cover layer is within a range of 52 to 56 Shore D and wherein the nominal thickness of the cover layer is within a range of 0.9 to 1.3 mm.

Optionally, the multi-piece golf ball constructions in accordance with any of the above described examples of this invention also may have any of the various dimple arrangements, dimple characteristics, and/or other dimple features described in the sub-section above.

3. Method Aspects

Additional aspects of this invention relate to methods of making golf balls. With regard to the various dimple arrangements, dimple characteristics, and/or other dimple features described above, the dimples may be formed in the cover layer of the ball in any desired manners without departing from this invention, including through the use of conventional techniques as are known and used in this art. As some more specific examples, dimples having the various dimple arrangements, dimple characteristics, and/or other dimple features described above may be formed in the cover layers of golf balls by molding techniques, such as compression molding or injection molding; by casting techniques; by laser forming techniques; etc. In the molding and casting techniques, the dimples may be formed by locating a liquid or semi-solid cover material between the ball's immediately adjacent inner layer and a mold having a negative of the desired dimple pattern formed therein to thereby shape the cover material to the desired shape (and to include the desired dimple pattern and dimensions in the cover layer) and then hardening the cover material (e.g., by curing, heating, pressure, etc.) to the final desired size and shape.

Another aspect of this invention relates to methods of forming multi-piece golf balls (e.g., three or more piece balls). Such methods may include one or more of the following steps: (a) providing a core made from one or more pieces (which may include formation steps, such as compression molding, injection molding, casting, etc.), wherein the core has a diameter within a range of 18 to 40 mm; (b) forming a mantle layer (e.g., by injection molding, compression molding, casting, etc.) immediately adjacent to and surrounding an outermost surface of the core, the mantle layer including a thermoplastic polyurethane containing material, wherein the mantle layer has a thickness within a range of 0.4 to 1.6 mm; (c) forming a cover layer to surround the mantle layer (e.g., by injection molding, compression molding, casting, etc.), the cover layer including a thermoplastic polyurethane containing material, wherein the cover layer has a nominal thickness within a range of 0.6 to 1.6 mm; and (d) applying at least one finish material over the cover layer to thereby produce a "finished" golf ball (i.e., a golf ball having at least one finish material (such as paint, a clear coat, etc.) applied to the outer cover). The method may further include one or more buffing or polishing steps as the various ball layers are being produced. The core of the finished golf ball may have an outermost surface hardness within a range of 53 to 61 Shore D, the mantle layer of the finished golf ball may have a surface hardness within a range of 64 to 72 Shore D, and the cover layer of the finished golf ball may have a surface hardness within a range of 50 to 58 Shore D. Optionally, the Shore D hardness of the mantle layer will be higher than the Shore D outermost surface hardness of the core and/or the Shore D surface hardness of the cover layer. In at least some example ball constructions according to this invention, in the finished golf ball, the surface hardness of the mantle layer will be at least 8 Shore D points higher than the outermost surface hardness of the core and/or at least 10 Shore D points higher than the surface hardness of the cover layer.

Still another example aspect of this invention relates to methods of forming multi-piece golf balls (e.g., four-piece, five-piece, or six-piece balls) that include one or more of: (a) providing a solid inner core including a thermoplastic resin material (which may include formation steps, such as compression molding, injection molding, casting, etc.), wherein the solid inner core has a diameter within a range of 20 to 29 mm; (b) forming an outer core layer to surround the solid inner core (e.g., by injection molding, compression molding, casting, etc.), the outer core layer including a polybutadiene rubber containing material or a thermoplastic resin containing material, wherein the outer core layer has a thickness within a range of 4 to 10 mm; (c) forming a mantle layer to surround the outer core (e.g., by injection molding, compression molding, casting, etc.), the mantle layer including a thermoplastic polyurethane containing material, wherein the mantle layer has a thickness within a range of 0.5 to 1.5 mm; (d) forming a cover layer to surround the mantle layer (e.g., by injection molding, compression molding, casting, etc.), the cover layer including a thermoplastic polyurethane containing material, wherein the cover layer has a nominal thickness within a range of 0.7 to 1.5 mm; (e) optionally, forming a layer between the mantle layer and the outer core layer; (f) optionally, forming a layer between the mantle layer and the cover layer; and/or (g) applying a finish material over the cover layer (e.g., by painting, coating, electrostatic coating, etc.) to thereby produce a finished golf ball (i.e., a golf ball having at least one finish material (such as paint, a clear coat, etc.) applied to the outer cover). The method may further include one or more buffing or polishing steps as the ball layers are being produced. The solid inner core of this finished golf ball may have a surface hardness within a range of 45 to 51 Shore D, the outer core layer of the finished golf ball may have a surface hardness within a range of 54 to 60 Shore D, the mantle layer of the finished golf ball may have a surface hardness within a range of 64 to 70 Shore D, and the cover layer of the finished golf ball may have a surface hardness within a range of 51 to 57 Shore D. Optionally, in the finished golf ball, the Shore D hardness of the mantle layer will be higher than the Shore D surface hardnesses of the solid inner core, the outer core layer, and/or the cover layer. As some more specific examples, in the finished golf ball, the surface hardness of the mantle layer may be at least 8 Shore D points higher than the surface hardness of the outer core layer, at least 16 Shore D points higher than the surface hardness of the solid inner core, and/or at least 10 Shore D points higher than the surface hardness of the cover layer.

If desired, the methods described above may be used to produce golf balls having any of the various ball constructions, ball hardnesses, layer thicknesses, dimple arrangements, dimple characteristics, and/or other dimple features described above.

Specific examples of the invention are described in more detail below. The reader should understand that these specific examples are set forth merely to illustrate examples of the invention, and they should not be construed as limiting the invention.

B. Specific Examples of the Invention

The various figures in this application illustrate examples of features of golf balls and methods in accordance with examples of this invention. When the same reference number appears in more than one drawing, that reference number is used consistently in this specification and the drawings to refer to the same or similar parts throughout.

1. Golf Ball Construction Aspects and Features

At least some aspects of this invention, such as the dimple aspects, may be practiced with any desired type of golf ball construction, including golf balls of conventional construction that include a liquid-filled center core, a solid center core, one-piece solid balls, and multi-piece solid balls (e.g., two-piece balls, three-piece balls, four-piece balls, five-piece balls, etc.).

FIG. 1A illustrates an example three-piece solid golf ball construction 100 that may include examples features of this invention. In this example structure, the ball 100 includes a solid center or inner core 102, a mantle layer 104 surrounding and immediately adjacent an outermost surface 102*a* of the inner core 102, and a cover layer 106 surrounding the mantle layer 104. The cover layer 106 includes a plurality of dimples 108 formed in its outer surface 106*a*.

The solid inner core 102 may be made from any desired materials without departing from this invention, such as rubbers (e.g., natural rubber, polybutadiene rubbers, etc.); elastomeric resin materials (e.g., thermoplastic resin materials including HPF 2000 thermoplastic resin materials (highly neutralized ionomers) available from E.I. DuPont Company of Wilmington, Del.); other elastomeric materials, and the like, including conventional golf ball core materials as are known and used in the art. The core material may be mixed with other additives to provide the desired final properties, as is known in the art. In golf ball products in accordance with some examples of this invention, the solid inner core 102 may have a surface hardness within a range of 42 to 54 Shore D and a diameter within a range of 18 to 36 mm. This hardness value is measured "on the ball" (on an exposed outer surface 102*a* of a solid inner core 102 of a ball) using standard test method ASTM D-2240. For finished balls, the core may be exposed for hardness testing by grinding or peeling off the cover 106 and other layers of the ball to expose the core surface 102*a*. During ball production, the hardness of the core 102 may be measured on a completed core 102 before any overlying layer is applied to it. The ball's core 102 may have a constant or substantially constant hardness (±10%) through its cross section (e.g., for thermoplastic resin cores of the types described above), or it may have a varying hardness through its cross section (e.g., a harder core surface 102*a* than center, such as for polybutadiene rubber cores).

The mantle layer 104 also may be made from any desired materials without departing from this invention, including ionomeric materials (e.g., SURLYN®, available from E.I. DuPont Company of Wilmington, Del.), thermoplastic polyurethane containing materials, and the like, including conventional interior golf ball layer materials as are known and used in the art. In a golf ball product, this mantle layer 104 may have a surface hardness within a range of 60 to 72 Shore D and a thickness within a range of 0.4 to 1.6 mm. This hardness value is measured "on the ball" (on an exposed outer surface 104*a* of a mantle layer 104 of a ball) using standard test method ASTM D-2240. For finished balls, the outer surface 104*a* of the mantle layer 104 may be exposed for hardness testing by grinding or peeling off its overlaying layers to expose surface 104*a*. During ball production, the hardness of the mantle layer 104 may be measured on the completed mantle 104 before an overlying layer is applied to it. As used in this specification, the term "mantle layer" will be reserved for the hardest interior layer of a golf ball construction, irrespective of its position within the layers of the golf ball.

The cover layer 106 also may be made from any desired materials without departing from this invention, including ionomeric materials (e.g., SURLYN®, available from E.I. DuPont Company of Wilmington, Del.), thermoplastic polyurethane containing materials, and the like, including conventional cover layer materials as are known and used in the art. In a golf ball product, this cover layer 106 (which also may be called an "outer cover layer" in this specification) may have a surface hardness within a range of 44 to 60 Shore D and a nominal thickness (i.e., at thickness at a location exclusive of the dimples 108) within a range of 0.6 to 1.6 mm. This hardness value is measured "on the ball" (on the exposed outer surface 106*a* of a cover layer 106 of a ball), at an area not including a dimple 108, using standard test method ASTM D-2240. This hardness measurement may be made before or after application of finish materials (if any) to the cover layer 106's outer surface 106*a*.

Figure 1B:
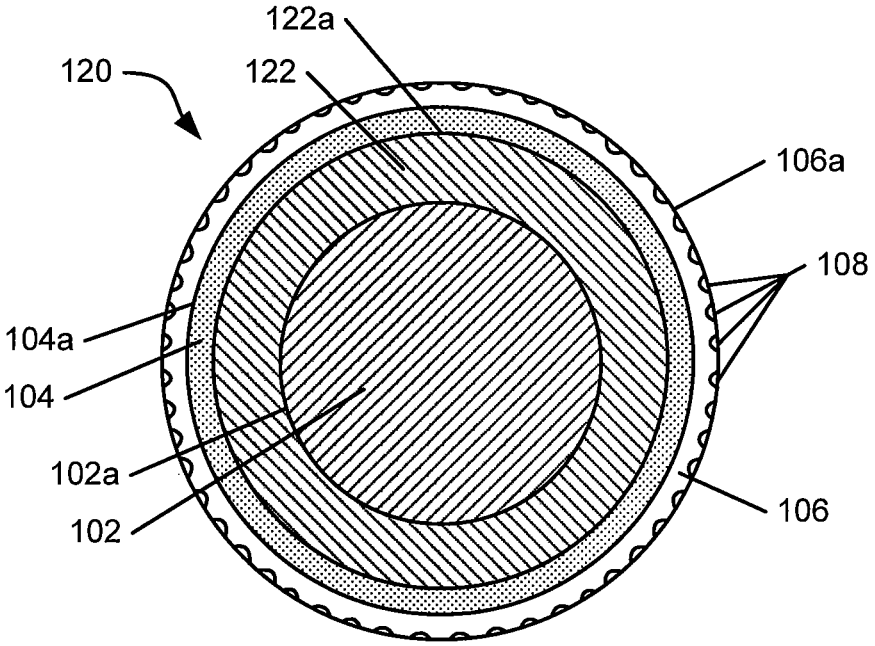

FIG. 1B illustrates an example four-piece solid golf ball construction 120 that may include example features of this invention. This example golf ball construction 120 includes various layers that may be the same as or similar to the three-piece ball 100 layers described above (e.g., a solid center or inner core 102, a mantle layer 104, and a cover layer 106), including the same potential materials, hardnesses, and/or thicknesses described above, as well as a plurality of dimples 108 formed in its outer cover surface 106*a*. This example golf ball structure 120, however, includes an additional layer 122 between the mantle layer 104 and the solid inner core 102. In a golf ball product, this additional layer 122 (which also may be called an "outer core layer" herein) may have a surface hardness within a range of 50 to 64 Shore D and a thickness within a range of 4 to 10 mm. This hardness value is measured "on the ball" (on an exposed outer surface 122*a* of a layer 122 of a ball) using standard test method ASTM D-2240. On a finished golf ball product, the outer surface 122*a* of the outer core layer 122 may be exposed for hardness testing by grinding or peeling off its overlaying layers to expose surface 122*a*. During ball production, the hardness of this layer 122 may be measured on the completed outer core layer 122 before an overlying layer is applied to it. As used in this specification, unless otherwise specified, the term "core" will be used generically to include a single solid core member (e.g., element 102 as shown in FIG. 1A) or a multi-layer core (e.g., combined elements 102 and 122 as shown in FIG. 1B). This outer core layer 122 may be made from any of the same materials as those noted above for the solid inner core 102 (e.g., rubbers, elastomeric resin materials, etc.).

Figure 1C:
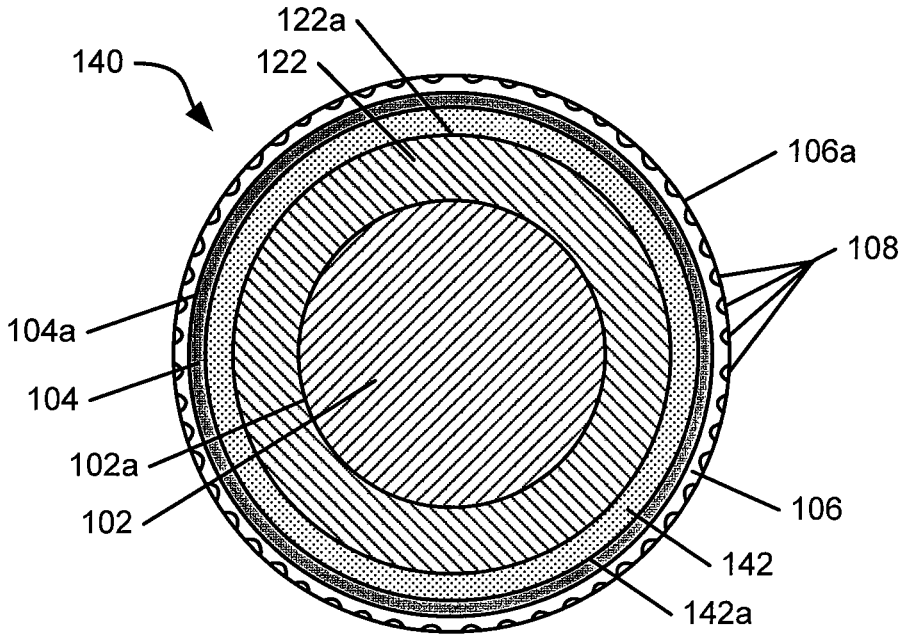
Figure 1D:
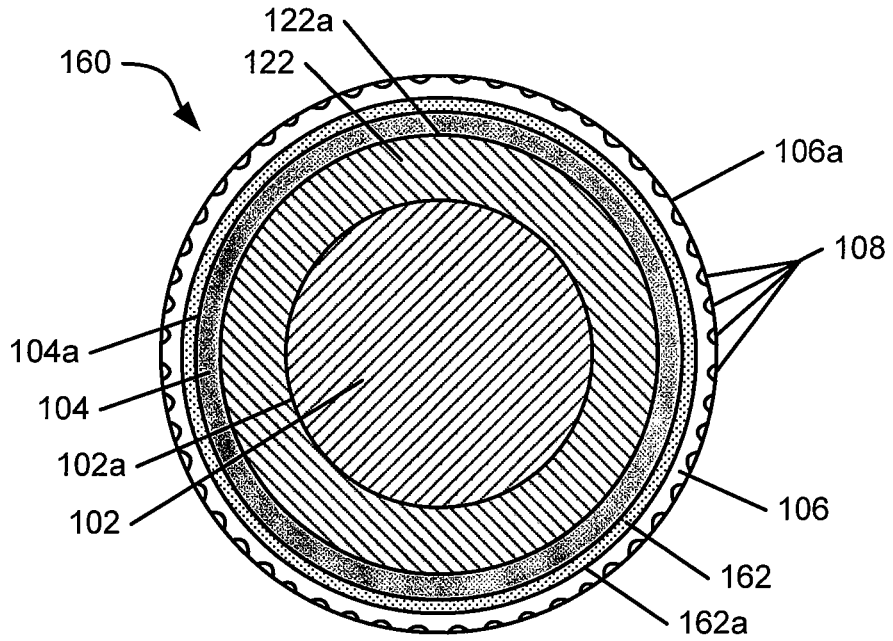

FIGS. 1C and 1D illustrate example five-piece solid golf ball constructions 140 and 160, respectively, that may include additional example features of this invention. These example golf ball constructions 140 and 160 include various layers that may be the same as or similar to the four-piece ball 120 layers described above (e.g., a solid center or inner core 102, a mantle layer 104, an outer core layer 122, and a cover layer 106), including the same potential materials, hardnesses, and/or thicknesses described above, as well as a plurality of dimples 108 formed in its outer cover surface 106*a*. The example golf ball structure 140 of FIG. 1C, however, includes an additional layer 142 between the mantle layer 104 and the outer core layer 122. This additional layer 142 also may be considered to be part of the ball's overall "core." In contrast, the example golf ball structure 160 of FIG. 1D includes an additional layer 162 between the mantle layer 104 and the outer cover layer 106 (in this position, the additional layer 162 also may be referred to herein as an "inner cover layer"). In a golf ball product, these additional layers 142 and 162 may have a surface hardness within a range of 30 to 64 Shore D and a thickness within a range of 0.1 to 4 mm. These hardness values are measured "on the ball" (on an exposed outer surface 142*a* and 162*a* of layer 142 and 162 of a ball product, e.g., exposed by grinding or peeling or measured before any overlying layers are applied to it) using standard test method ASTM D-2240. These additional layers 142 and 162 may be made from any desired materials, including any of the specific materials identified above and/or any materials conventionally known and used in golf ball construction.

While the surfaces of the various interior layers of the balls (e.g., surfaces 102*a*, 104*a*, 122*a*, 142*a*, and/or 162*a*) are shown as smooth spherical surfaces in the various figures, this is not a requirement. Rather, if desired, structure may be incorporated into any and/or all of these interior layers, such as the inclusion of dimples, voids, slots, grooves, recesses, etc. Any such dimples, voids, slots, grooves, recesses, or the like may be filled in by the surface of its immediately adjacent layer or they may be left unfilled. Also, the interior of any layer or element in the ball may include voids, if desired. Shapes other than spherical may be used for some layers (e.g., egg shaped, ellipsoidal shaped, etc.), if desired.

Also, if desired, an adhesive layer may be provided at the interface between any adjacent layers of the ball (e.g., between the outer surface of one layer and an inner surface of an adjacent layer). As one more specific example, for a four piece ball (e.g., as shown in FIG. 1B), a layer of adhesive may be provided on surface 102*a* and located between the center core 102 (optionally made from a resin material, as described above and in more detail below) and the outer core layer 122 (optionally made from a rubber material, as described above and in more detail below). While any desired types of adhesives may be used without departing from this invention, in some example ball constructions, the adhesive may be an ethylvinylacetate ("EVA") film provided on the outer surface 102*a* of the center core 102.

The following tables provide additional examples of more specific golf ball constructions in accordance with examples of this invention.

A first example ball in accordance with at least some aspects of this invention has a four-piece construction like that shown in FIG. 1B, with the following ranges of properties and/or features:

TABLE 1

| | | General Range | Intermediate Range | Specific |
|---|---|---|---|---|
| Center Core | Material | HPF Resin Containing Material | HPF Resin + a Sulfate Additive | HPF + $BaSO_4$ |
| | Specific Gravity | 1 to 1.25 | 1 to 1.125 | 1.006 |
| | Hardness | 48 to 58 Shore D | 50 to 56 Shore D | 53 Shore D |
| | Diameter | 18 to 38 mm | 22 to 34 mm | 28 mm |
| Outer Core Layer | Material | Rubber Containing Material | Polybutadiene Rubber Containing Material | Polybutadiene Rubber |
| | Specific Gravity | 1 to 1.25 | 1 to 1.125 | 1.07 |
| | Hardness | 50 to 66 Shore D | 52 to 60 Shore D | 56 Shore D |
| Mantle Layer | Material | HPF Resin Containing Material | HPF Resin + a Sulfate Additive | HPF + $BaSO_4$ |
| | Specific Gravity | 1.1 to 1.6 | 1.15 to 1.5 | 1.25 |
| | Hardness | 52 to 68 Shore D | 54 to 64 Shore D | 58 Shore D |
| | Thickness | 1 to 3 mm | 1.5 to 2.6 mm | 2.2 mm |
| Outer Cover Layer | Material | TPU Containing Material | TPU Containing Material | TPU |
| | Specific Gravity | 1 to 1.5 | 1.1 to 1.4 | 1.2 |
| | Hardness | 50 to 60 Shore D | 52 to 58 Shore D | 54 to 56 Shore D |
| | Nominal Thickness | 0.8 to 1.8 mm | 1 to 1.6 mm | 1.2 mm |
| Overall Ball | Compression (10 to 130 kg load) | 2 to 3 | 2.2 to 2.8 | 2.4 to 2.7 |

Another example ball in accordance with at least some aspects of this invention has a four-piece construction like that shown in FIG. 1B, with the following ranges of properties and/or features:

TABLE 2

| | | General Range | Intermediate Range | Specific |
|---|---|---|---|---|
| Center Core | Material | HPF Resin Containing Material | HPF Resin + a Sulfate Additive | HPF + $BaSO_4$ |
| | Specific Gravity | 1 to 1.25 | 1 to 1.125 | 1.006 |
| | Hardness | 46 to 58 Shore D | 48 to 56 Shore D | 53 Shore D |
| | Diameter | 18 to 38 mm | 22 to 34 mm | 28 mm |
| Outer Core Layer | Material | Rubber Containing Material | Polybutadiene Rubber Containing Material | Polybutadiene Rubber |
| | Specific Gravity | 1 to 1.25 | 1 to 1.125 | 1.07 |
| | Hardness | 50 to 66 Shore D | 52 to 60 Shore D | 56 Shore D |
| Mantle Layer | Material | TPU Containing Material | TPU Containing Material | TPU |
| | Specific Gravity | 1.1 to 1.6 | 1.15 to 1.5 | 1.2 |
| | Hardness | 52 to 70 Shore D | 58 to 68 Shore D | 62 to 64 Shore D |
| | Thickness | 0.4 to 2.5 mm | 0.4 to 1.5 mm | 0.6 mm |
| Outer Cover Layer | Material | TPU Containing Material | TPU Containing Material | TPU |
| | Specific Gravity | 1 to 1.5 | 1.1 to 1.4 | 1.2 |
| | Hardness | 46 to 64 Shore D | 50 to 60 Shore D | 52 to 58 Shore D |
| | Nominal Thickness | 0.6 to 2 mm | 1 to 1.6 mm | 1.2 mm |
| Overall Ball | Compression (10 to 130 kg load) | 2 to 3 | 2.2 to 2.8 | 2.4 to 2.7 |

Another example ball in accordance with at least some aspects of this invention has the general and intermediate properties like those described above in Table 2 and the following more specific properties and features or ranges of properties and/or features:

(a) Center Core Material: HPF 2000+$BaSO_4$ (e.g., HPF/$BaSO_4$ at a ratio of 86/14 parts by weight (HPF 2000 is a highly neutralized ionomer available from E.I. DuPont Company of Wilmington, Del.)

(b) Center Core Specific Gravity: 1.006

(c) Center Core Hardness: 53 Shore D (d) Center Core Diameter: 28 mm (e) Outer Core Material: Polybutadiene Rubber (e.g., Kumho NdBR-40 rubber available from Korea Kumho Petrochemical Co., which includes: 100 parts by weight NdBR (neodymium-based polybutadiene rubber); 9 parts by weight zinc oxide (ZnO); 5 parts by weight barium sulfate ($BaSO_4$); 0.6 parts by weight peroxide cross-linking agent (e.g., 3M/231 available from Degussa Initiators GmbH & Co. of Germany); 1 part by weight DCP (a dicumyl peroxide cross linking agent); 31 parts by weight zinc diacrylate (ZDA, a curing agent); 0.46 parts by weight liquid phenolic resin plasticizer (e.g., such as LPR available from Holy Hill Trading Co., of Taiwan); 0.6 parts by weight zinc salt of pentachlorothiophenol; and 0.1 parts by weight antidegradants) (if desired, the zinc salt of pentachlorothiophenol may be of the types described in U.S. Pat. No. 7,566,280, which patent is entirely incorporated herein by reference)

(f) Outer Core Specific Gravity: 1.07

(g) Outer Core Hardness: 54 to 56 Shore D (h) Outer Core Compression (10 to 130 kg load): 2.2 to 2.6 mm
(i) Outer Core PGA Compression: 94
(j) Mantle Layer Material: TPU (e.g., neothane 6303 available from Dongsung Highchem Co., Ltd.)
(k) Mantle Layer Specific Gravity: 1.2
(l) Mantle Layer Hardness: 64 to 66 Shore D
(m) Mantle Layer Thickness: 0.6 mm
(n) Mantle Layer Compression (10 to 130 kg load): 2.3 to 2.6 mm
(o) Mantle Layer PGA Compression: 96
(p) Outer Cover Material: TPU (e.g., neothane 4515 available from Dongsung Highchem Co., Ltd.)
(q) Outer Cover Specific Gravity: 1.2
(r) Outer Cover Hardness: 52 Shore D
(s) Outer Cover Thickness: 1.2 mm
(t) Overall Ball Compression (10 to 130 kg load): 2.2 to 2.6 mm
(u) Overall Ball PGA Compression: 96

Another example ball in accordance with at least some aspects of this invention has the general and intermediate properties like those described above in Table 2 and the following more specific properties and features or ranges of properties and/or features:

(a) Center Core Material: HPF 2000/AD 1035 mixture (in a weight ratio of 85/15)+$BaSO_4$ (HPF+AD mix/$BaSO_4$ weight ratio of 86/14) (AD 1035 is a highly neutralized ionomer available from E.I. DuPont Company of Wilmington, Del.)
(b) Center Core Specific Gravity: 1.006
(c) Center Core Hardness: 50 Shore D
(d) Center Core Diameter: 24 mm
(e) Outer Core Material: Polybutadiene Rubber (e.g., Kumho NdBR-40 material identified above)
(f) Outer Core Specific Gravity: 1.07
(g) Outer Core Hardness: 54 to 60 Shore D
(h) Outer Core Compression (10 to 130 kg load): 2.2 to 2.6 mm
(i) Outer Core PGA Compression: 94
(j) Mantle Layer Material: TPU (e.g., Dongsung Highchem Neothane 6303D identified above)
(k) Mantle Layer Specific Gravity: 1.2
(l) Mantle Layer Hardness: 64 to 66 Shore D
(m) Mantle Layer Thickness: 0.6 mm
(n) Mantle Layer Compression (10 to 130 kg load): 2.3 to 2.6 mm
(o) Mantle Layer PGA Compression: 96
(p) Outer Cover Material: TPU (e.g., Dongsung Highchem Neothane 4515D identified above)
(q) Outer Cover Specific Gravity: 1.2
(r) Outer Cover Hardness: 52 Shore D
(s) Outer Cover Thickness: 1.2 mm
(t) Overall Ball Compression (10 to 130 kg load): 2.2 to 2.6 mm
(u) Overall Ball PGA Compression: 96

Another example ball in accordance with at least some aspects of this invention has the general and intermediate properties like those described above in Table 2 and the following more specific properties and features or ranges of properties and/or features:

(a) Center Core Material: HPF 2000/AD 1035 mixture (weight ratio of 65/35)+$BaSO_4$ (HPF+AD mix/$BaSO_4$ weight ratio of 86/14)
(b) Center Core Specific Gravity: 1.006
(c) Center Core Hardness: 48 Shore D
(d) Center Core Diameter: 24.5 mm
(e) Outer Core Material: Polybutadiene Rubber (e.g., Kumho NdBR-40 material identified above)
(f) Outer Core Specific Gravity: 1.07
(g) Outer Core Hardness: 57 Shore D
(h) Outer Core Compression (10 to 130 kg load): 2.2 to 2.6 mm
(i) Outer Core PGA Compression: 94
(j) Mantle Layer Material: TPU (e.g., Dongsung Highchem Neothane 6303D identified above)
(k) Mantle Layer Specific Gravity: 1.2
(l) Mantle Layer Hardness: 67 Shore D
(m) Mantle Layer Thickness: 1 mm
(n) Mantle Layer Compression (10 to 130 kg load): 2.3 to 2.6 mm
(o) Mantle Layer PGA Compression: 96
(p) Outer Cover Material: TPU (e.g., Dongsung Highchem Neothane 4515D identified above)
(q) Outer Cover Specific Gravity: 1.2
(r) Outer Cover Hardness: 52 Shore D
(s) Outer Cover Thickness: 1.1 mm
(t) Overall Ball Compression (10 to 130 kg load): 2.5 mm
(u) Overall Ball PGA Compression: 96

Various changes and modifications can be made to these ball constructions without departing from this invention, including adding or eliminating individual layers; modifying the hardnesses, specific gravity, thicknesses, and/or compressions of various layers; modifying the materials of the various layers; etc., to arrive at a final ball having the desired final characteristics, such as spin, overall hardness, sound at impact, lift, drag, etc. Golf balls of any of these constructions also may have any of the dimple features described below.

2. Dimple Dimension and Shape Aspects and Features

As noted above, at least some aspects of this invention relate to dimple features on exterior cover layers of golf balls. While the golf ball's dimples may have a wide variety of features and characteristics without departing from this invention, FIGS. 2A through 2F help illustrate and explain the meaning of various terms as used in this specification.

Figure 2A:
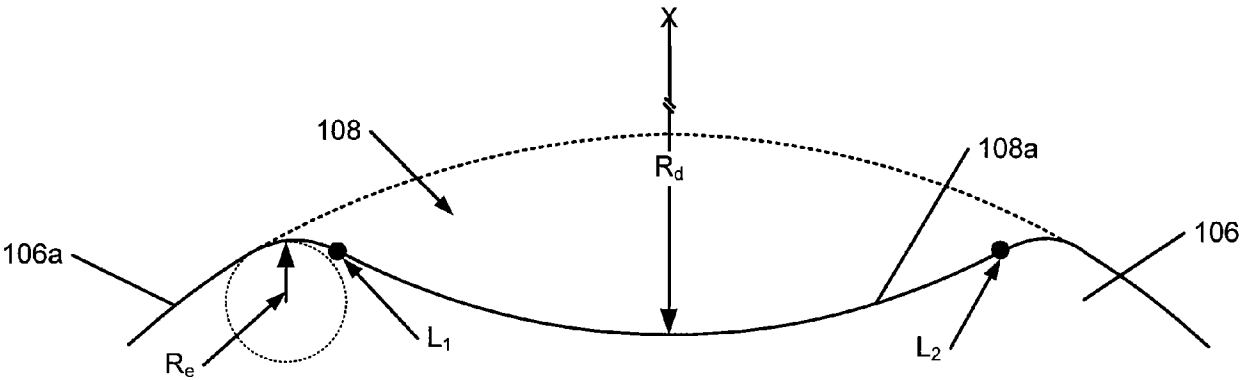
FIGS. 2A through 2F illustrate various dimple features that may be included in golf balls in accordance with at least some example aspects of this invention, and these figures also assist in explaining various dimple terms used in this specification.

FIG. 2A illustrates a cross-sectional view of a portion of a golf ball cover layer 106 with a dimple 108 formed in an outer surface 106*a* thereof. The partial cross-sectional view of FIG. 2A is taken at a center of dimple 108 that has a round perimeter edge shape 108E (see FIG. 2D) when looking directly down at the dimple 108 on the ball's surface 106*a*. As shown in FIG. 2A, this example dimple 108 has a circular arc cross-sectional shape (a circular arc formed in the cover layer 106 of the ball), wherein at least the central 75% of the cross-sectional length (between points $L_1$ and $L_2$ in FIG. 2A) of the interior surface 108*a* of the dimple 108 has a single radius $R_d$. In other words, in this example, at least the central 75% of the dimple surface 108*a* constitutes a sector or portion of a spherical surface having a radius $R_d$. When dimples in golf balls according to examples of this invention have a circular arc cross sectional shape, the dimple radius $R_d$ may have a range of values in dimple constructions in accordance with this invention, as will be described in more detail below.

If desired, dimples in accordance with at least some examples of this invention may have a sharp or abrupt corner at the junction of the surface 106*a* of the cover layer 106 and the interior surface 108*a* of the dimple 108. Often, however, as shown in FIG. 2A, the dimple edge will be more rounded, e.g., having an edge radius $R_e$. While any desired edge radius may be provided in dimple constructions in accordance with examples of this invention, in some more specific examples, the edge radius $R_e$ will be in the range of 0.1 to 5 mm, and in some examples, within the range of 0.25 to 3 mm or even within the range of 0.25 to 1.5 mm. Some example balls according to this invention will have edge radii $R_e$ of about 0.5 mm. The edge radii $R_e$ may be the same or different for the various dimples on a given golf ball construction. Dimples 108 may still be considered to have a spherical sector shape and a circular arc cross sectional shape even when the extreme edges of the dimple 108 have a different shape (such as a rounded corner or edge) to facilitate transition between the interior dimple surface 108*a* and the outermost cover layer surface 106*a*. As used in this specification, a dimple will be considered to have a circular arc cross sectional shape if the central 75% of the dimple's cross sectional surface 108*a* constitutes an arc of a circle and a dimple will be considered to have a spherical sector surface shape if the central 75% of the dimple's surface area constitutes a portion of a spherical surface.

Figure 2B:
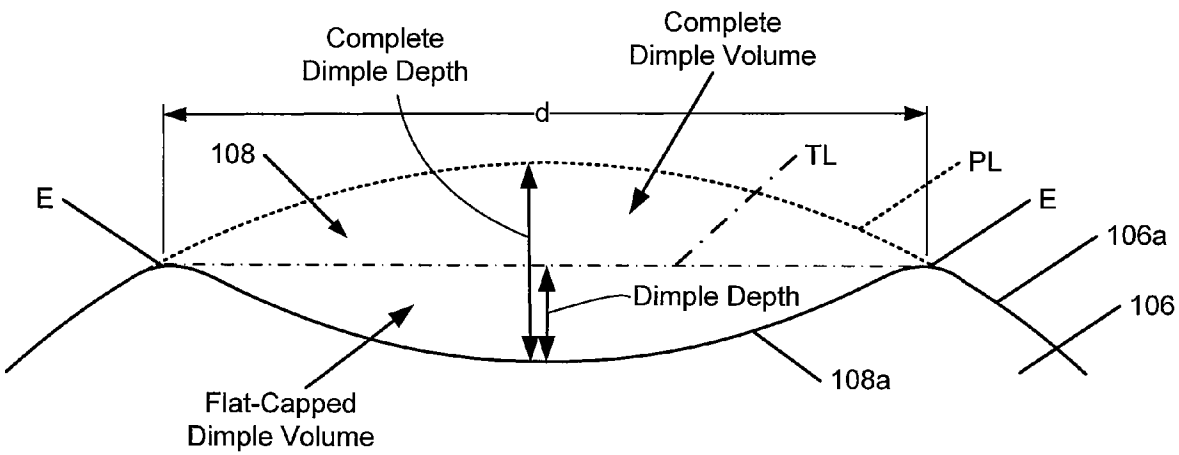

FIG. 2B illustrates additional features that may be included in dimple constructions in accordance with at least some examples of this invention. As shown in FIG. 2B, a phantom line (broken line PL) shows where the surface 106*a* of the golf ball's outermost cover layer 106 would be located if the dimple 108 was not present on the ball. The edge (or perimeter) of the dimple 108 may be determined by locating the points E at which tangents at the exact opposite sides of the dimple 108 are parallel (to thereby provide the single dot-dash line TL shown in FIG. 2B). These tangent points E define the dimple 108's edge, and for dimples having a round perimeter edge, the distance between the opposite tangent points E is defined as the dimple's "diameter" d as that term is used in this specification. For dimples having other perimeter shapes (such as polygons, ellipses, ovals, etc.), a similar dimple dimensional size may be defined, such as length, width, major axis, minor axis, major radius, minor radius, chord length, diagonal length, etc.

The dimple's "depth," as used in this specification, means the dimension of the dimple from its deepest point to the tangent line TL, as shown in FIG. 2B. For spherical sector dimples having a circular arc cross sectional shape, this dimple "depth" will be measured at the geometric center of the dimple 108, from the tangent line TL to the dimple interior surface 108*a* at the dimple 108's center. Another dimple "depth" value may be obtained as the dimension from the phantom surface of the golf ball to the dimple's deepest point (for spherical sector dimples, at the dimple 108's center from the phantom line PL to the dimple interior surface 108*a* at the dimple 108's center). In this specification, when the term dimple "depth" is used without further explanation or qualifier, it is intended to mean the dimple depth from the tangent line TL to the dimple's deepest point (which also may be called the "flat-capped dimple depth" in this specification because it is measured from the plane or "cap" defined by the set of tangent lines TL that extend between and define the dimple edge E). The term "complete dimple depth" will be specifically used in this specification when the depth from the phantom line PL to the dimple's deepest point is intended (the line for the complete dimple depth is shown offset from the dimple 108's center in FIG. 2B so as not to obscure the line for the flat-capped dimple depth).

At least two different dimple volumes also may be defined for a specific dimple. One dimple volume is defined as the volume defined between the tangent lines TL that extend between and define the dimple edge E to the dimple surface (e.g., surface 108*a* as shown in FIG. 2B). This volume also may be called the "flat-capped dimple volume" in this specification because it is measured from the plane or "cap" defined by the set of tangent lines TL that extend between and define the dimple edge E. A second dimple volume may be defined as the volume between the phantom spherical surface of the ball (i.e., where the ball surface would be if no dimples were present) and the dimple surface (e.g., surface 108*a* shown in FIG. 2B). In this specification, when the term dimple "volume" is used without further explanation or qualifier, it is intended to mean the dimple volume as measured from the series of tangent lines TL that define the dimple perimeter to the dimple's surface (the "flat-capped dimple volume"). The term "complete dimple volume" will be specifically used in this specification when the volume as measured between the phantom ball surface and the dimple surface is intended.

Figure 2C:
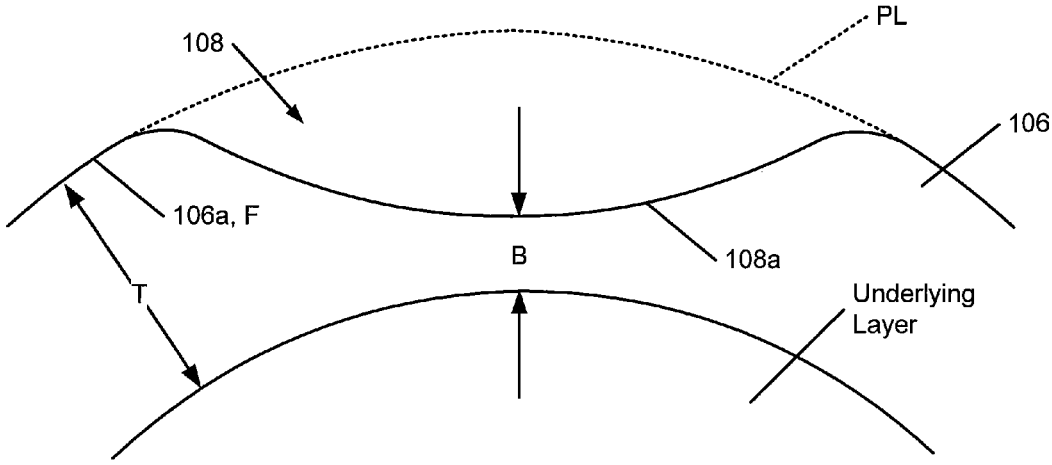

FIG. 2C illustrates additional dimple features that may be discussed in this specification and/or used in defining at least some aspects of this invention. FIG. 2C illustrates various features of the cover layer 106 thickness. As shown in FIG. 2C, because of its dimples 108, the cover layer 106 of a golf ball does not have a constant thickness. Therefore, the terms "cover layer thickness" and "nominal thickness" as used in this specification refer to the thickness of the cover layer 106, as measured along a radius of the ball's sphere, at a location away from any dimple 108 (i.e., at the fret or land areas F between dimples 108 and not at an area corresponding to a dimple surface 108*a*). One example of this "cover layer thickness" and "nominal thickness" dimension is shown in FIG. 2C as dimension "T".

FIG. 2C illustrates another cover layer dimension, dimension B, which is the cover layer dimension along a radius of the ball's sphere at the deepest point of a dimple 108. The dimples on golf balls according to at least some examples of this invention may have a wide range of B/T values, such as from the range of 0.4 to 0.95, and in some examples, within the range of 0.5 to 0.9, or even 0.6 to 0.85. The B/T ratio may differ for various different dimple types on a given ball surface.

Figure 2D:
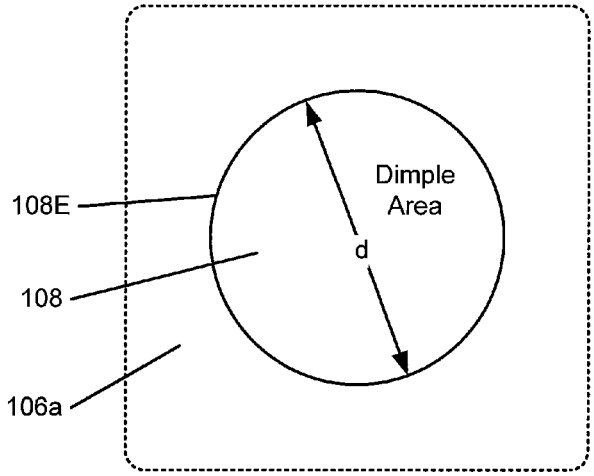

Some aspects of this invention also may relate to dimple surface area coverage on the ball. For an individual dimple, the dimple's surface area may be defined by the area defined by the dimple edge E as described above. For a dimple with a circular perimeter shape, as shown in FIG. 2D, this area may be defined as $\pi\times(d/2)^2$ (wherein "d" is the individual dimple diameter), for dimples with a square perimeter shape, this area may be defined as $s^2$ (where "s" is the length of an edge of the dimple), and for dimples with a rectangular perimeter shape, this area may be defined as l×w (where "l" is the length of one edge of the dimple and "w" is the length of an adjacent edge of the dimple). Other individual dimple areas may be determined in this same general manner for determining areas of a shape of a flat-capped dimple perimeter. The ratio $A_d/A_b$ of the total dimple area (parameter $A_d$, which is the sum of the individual dimple surface areas) to the surface area of a phantom surface of the ball (parameter $A_b$, which is the ball's surface area from its outermost surface assuming that the ball includes no dimples) may be at least 70%, and in some examples, at least 72% or within a range from 72% to 85% or even within a range from 72% to 78%. In at least some examples of this invention in which all dimples have a round perimeter, the ratio $A_d/A_b$ will be within any of the ranges mentioned above, wherein $A_d$ is a total dimple surface coverage area as determined by Formula (I):

$$A_d = \sum_{n=1}^{M} \pi \times (d_n/2)^2, \qquad \text{Formula (I)}$$

wherein "M" is a total number of dimples on the golf ball, and "d" is an individual dimple diameter, and wherein $A_b$ is a total golf ball surface area assuming no dimples are present on the ball as determined by Formula (II):

$$A_b=4\pi\times(D/2)^2 \quad \text{Formula (II)},$$

wherein "D" is an outermost diameter of the golf ball.

Figure 2E:
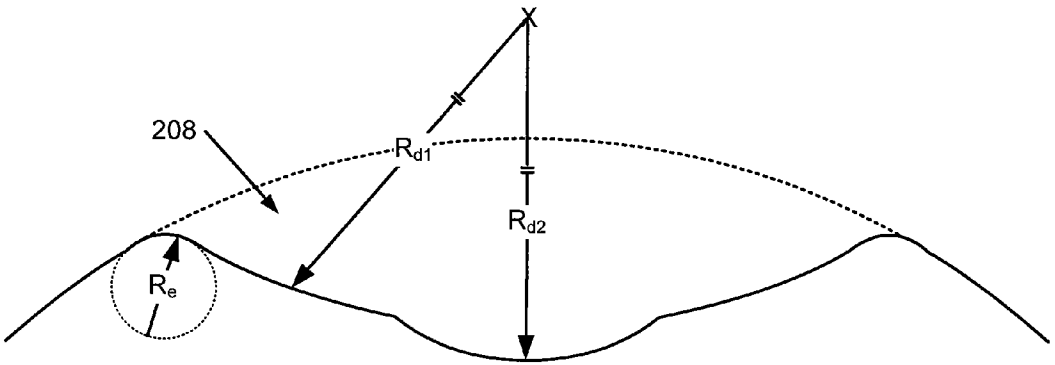

Much of the above description relates to dimples having a circular arc cross-sectional shape and a round perimeter shape. These are not requirements in all aspects of this invention. Rather, the dimples included in golf balls in accordance with some examples of this invention may have a variety of different cross-sectional shapes, perimeter shapes, and the like. FIG. 2E illustrates another example dimple structure 208 in which the cross-sectional shape has a "dual radius" configuration. More specifically, as shown in FIG. 2E, the central portion of this dimple 208 includes an upper (or perimeter) portion (i.e., the portion toward the dimple's edge) having a first radius of curvature ($R_{d1}$) and a lower (or central) portion (i.e., the portion toward the dimple's center) having a second radius of curvature ($R_{d2}$), wherein the centers of each radius of curvature are located outside the ball. $R_{d1}$ may be greater than or less than $R_{d2}$, and in some examples of this invention, $R_{d1}$ may be within a range of $0.2R_{d2}$ to $5R_{d2}$, and in some examples, from $0.25R_{d2}$ to $4R_{d2}$ or even from $0.5R_{d2}$ to $2R_{d2}$. Balls according to at least some examples of this invention also may have a triple (or more) radius construction.

Figure 2F:
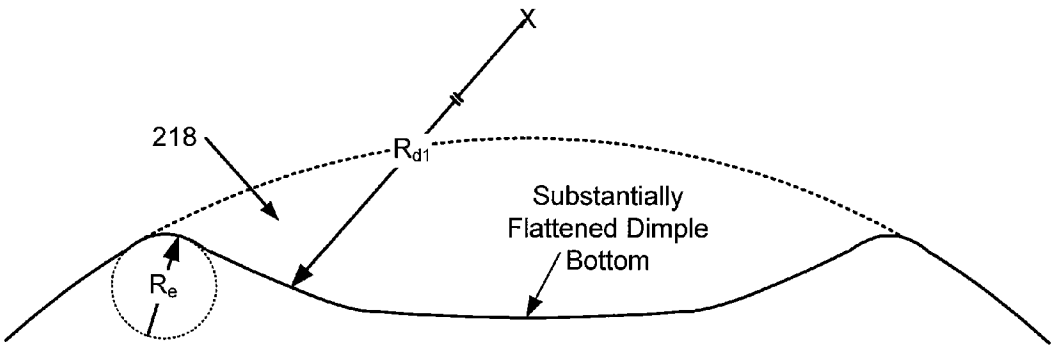

FIG. 2F shows another example dimple cross-sectional shape. In this instance, the upper (or perimeter) portion of the dimple 218 (i.e., the portion toward the dimple's edge) has a first radius of curvature ($R_{d1}$) and the lower (or central) portion of the dimple 218 (i.e., the portion toward the dimple's center) has a flat or substantially flat bottom structure. If desired, the bottom central portion of the dimple may have a convex shape (i.e., protrude outward toward the ball's exterior surface). Other dimple cross-sectional shapes may be provided in golf balls in accordance with at least some examples of this invention, such as dimples with annular rings (raised from the dimple interior surface or cut into the dimple interior surface), dimples with grooves of any desired shape cut into a portion of the dimple interior surface, dimples with raised nubs of any desired shape raised from the interior dimple surface, faceted dimple interior surfaces, cylindrical shaped dimple surfaces, etc.

The dimples on a golf ball also may have different perimeter shapes without departing from this invention, such as polygonal (e.g., triangular, square, rectangular, pentagonal, hexagonal, octagonal, etc.), elliptical, oval, tear drop, football, star, irregular, etc.

Two dimples will be of different "types," as that term is used in this specification, if, when the dimples are formed in the cover layer (e.g., during molding, casting, etc.), one dimple differs from the other dimple in any significant manner, such in diameter, depth, radius, volume, surface area, cross-sectional shape, etc. Dimples differ "significantly" if there is more than a 4% difference in any of the above noted dimensions or properties. Two dimples will be of the same "type" if, when the dimples are molded, cast, or otherwise initially created, the two dimples have the same dimensions and shapes (e.g., the same diameter, depth, radius, volume, surface area, cross-sectional shape, etc.), i.e., if the dimples do not differ "significantly" (by more than 4% in any of the above noted dimensions or properties). As used in this specification, later treatments to the ball surface, such as painting, clear coating, and the like, will not change dimples of one type to dimples of another type, even though some variation then may exist from dimple to dimple within a given type (e.g., due to pooling of coating materials, run-off of coating materials, etc.). Buffing or polishing the ball (e.g., around the seam line, if any such treatments are necessary) also generally will not be considered to change one dimple type to another dimple type unless the buffing or polishing changes "significantly" one or more of the above noted dimensions or properties (e.g., change the dimension by more than 4%) and/or unless the buffing or polishing is intended to alter one or more of an individual dimple's dimensions to match another dimple type's dimensions.

3. Dimple Layout Aspects and Features

Figure 3A:
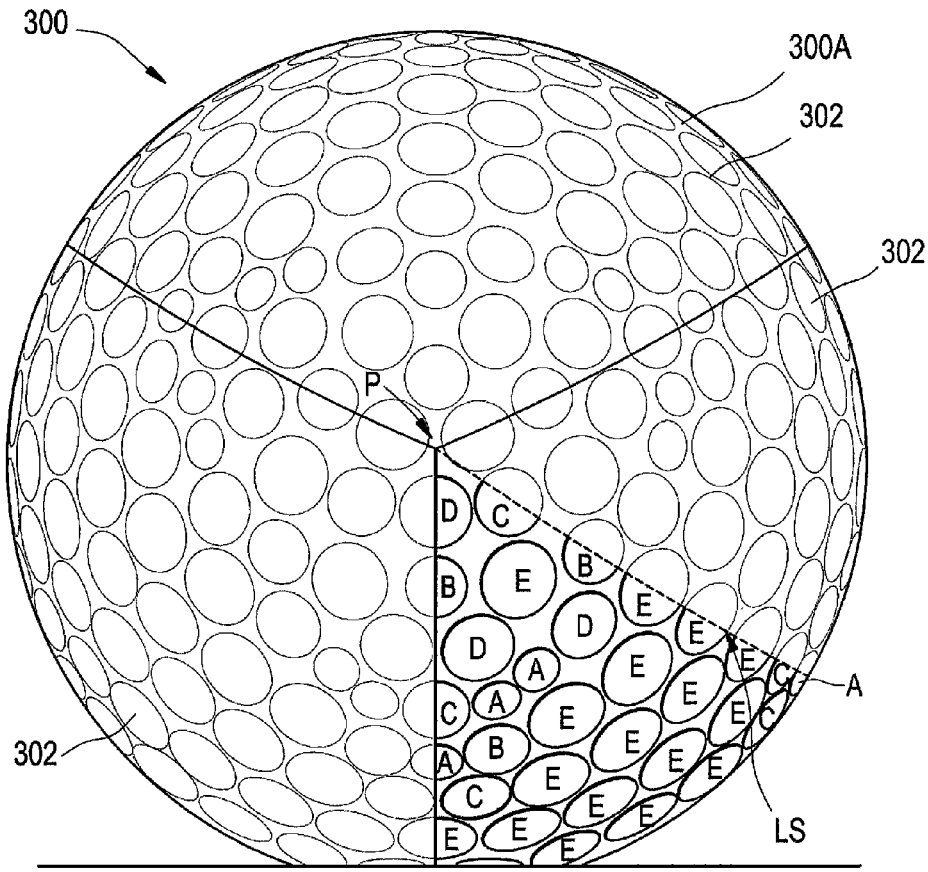
FIGS. 3A and 3B show top and front views, respectively, of an example golf ball dimple pattern in accordance with at least some aspects of this invention.
Figure 3B:
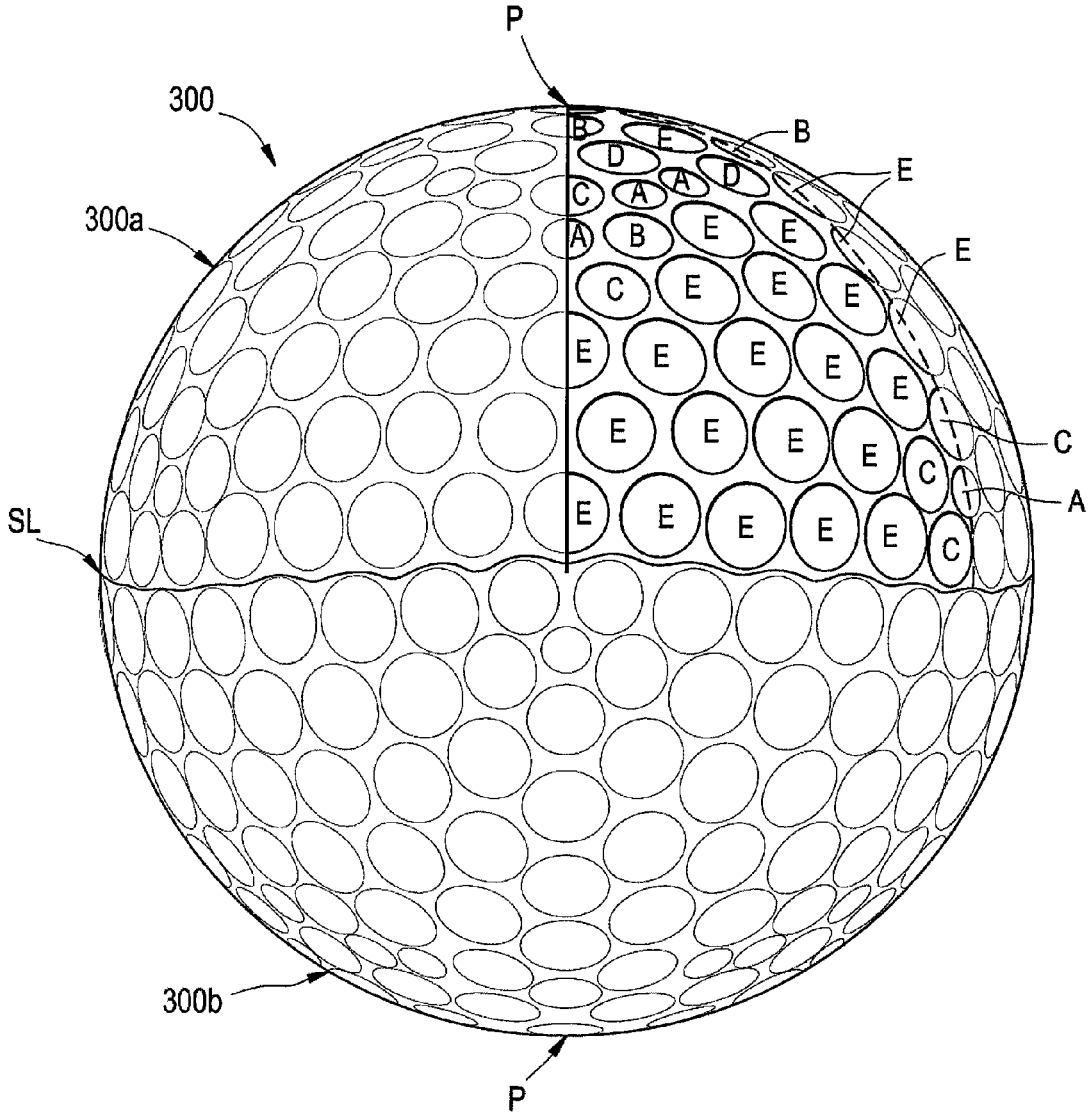

Various aspects of this invention relate to aspects and features of dimple layouts and arrangements on the golf ball surface. FIGS. 3A and 3B help illustrate some of the dimple layout and arrangement features according to aspects of this invention. First, as shown in these figures, a golf ball 300 includes two halves 300*a* and 300*b*, each of a substantially hemispherical shape, although, as shown in the front view of FIG. 3B, the bottom of each ball half 300*a* and 300*b* may be curved or stepped to help provide a seam line SL on the ball that does not correspond to a "great circle" or equator around the ball. In this manner, the ball 300 may have a "seamless" appearance in that all great circles on the ball 300, including a great circle at the ball's equator (half way between the poles P), will intersect at least one dimple (there is no apparent seam line where the mold halves join in producing this ball).

The golf ball 300's dimples (types A through E, in this example structure) are arranged in N repeating sectors 302 in each half 300*a* and 300*b*, wherein N is an integer within the range of 2 to 10, and in some examples from 2 to 8 or even from 3 to 6. In the specific example ball 300 of FIGS. 3A and 3B, each ball half 300*a* and 300*b* includes 3 sectors 302 that repeat around the pole P (each sector 302 covers 120° of the ball perimeter) for a total of 6 sectors on the overall ball 300 surface. Each individual sector 302 in this example dimple arrangement includes a line of symmetry LS (shown as a broken line in FIG. 3A), and the individual dimples (and dimple portions) within that sector on one side of the line of symmetry LS are arranged in a mirror image from the individual dimples (and dimple portions) on the other side of the line of symmetry LS within the same sector 302. If desired, one or more sectors may be provided in the dimple pattern half that do not include lines of symmetry, e.g., interspersed with the sectors that include lines of symmetry. In other words, this invention does not require that each identifiable sector of dimples on a ball must include a line of symmetry.

As shown in FIG. 3A, each sector 302 is a spherical triangular region. If desired (although not required), at least some of these sectors 302 may share a common point or even a common side. In the example structure shown in FIG. 3A, the sectors 302 in each hemisphere 300*a* and 300*b* share the pole point P of that hemisphere. Alternatively, if desired, the sectors 302 need not share a common point (e.g., the spherical triangles may be spaced downward from the pole point P) and/or they need not share a common edge (e.g., other, different sectors may be located between the sectors 302 having the same dimple patterns).

While the dimple pattern half (i.e., the dimple layout and arrangement) on one ball half 300*a* is the same as the dimple pattern half (i.e., the dimple layout and arrangement) on the other ball half 300*b*, the dimples are not arranged in a mirror image across the seam line SL. Rather, as evident from FIG. 3B, the dimple pattern halves 300*a* and 300*b* are rotationally offset from one another across the seam line SL location, e.g., by an offset amount within a range of 2° to 90°, 5° to 60°, 5° to 45°, 10° to 45°, 10° to 30°, and even 15° to 30°. In the illustrated example of FIGS. 3A and 3B, this rotational offset amount is about 60°.

Any desired number of overall dimples may be included on the ball without departing from this invention, such as from 320 to 432 total dimples, or even 330 to 392 total dimples. Some specific golf ball dimple arrangements according to examples of this invention will include 360 and 390 total dimples. The specific dimple arrangement of FIGS. 3A and 3B includes 390 total dimples (with 65 dimples per sector and 32.5 dimples per half sector), with five different dimple types (types A through E) arranged on the ball 300. As shown in FIGS. 3A and 3B, two adjacent sectors 302 may share an individual dimple such that each sector contains one-half of that dimple.

Figure 4A:
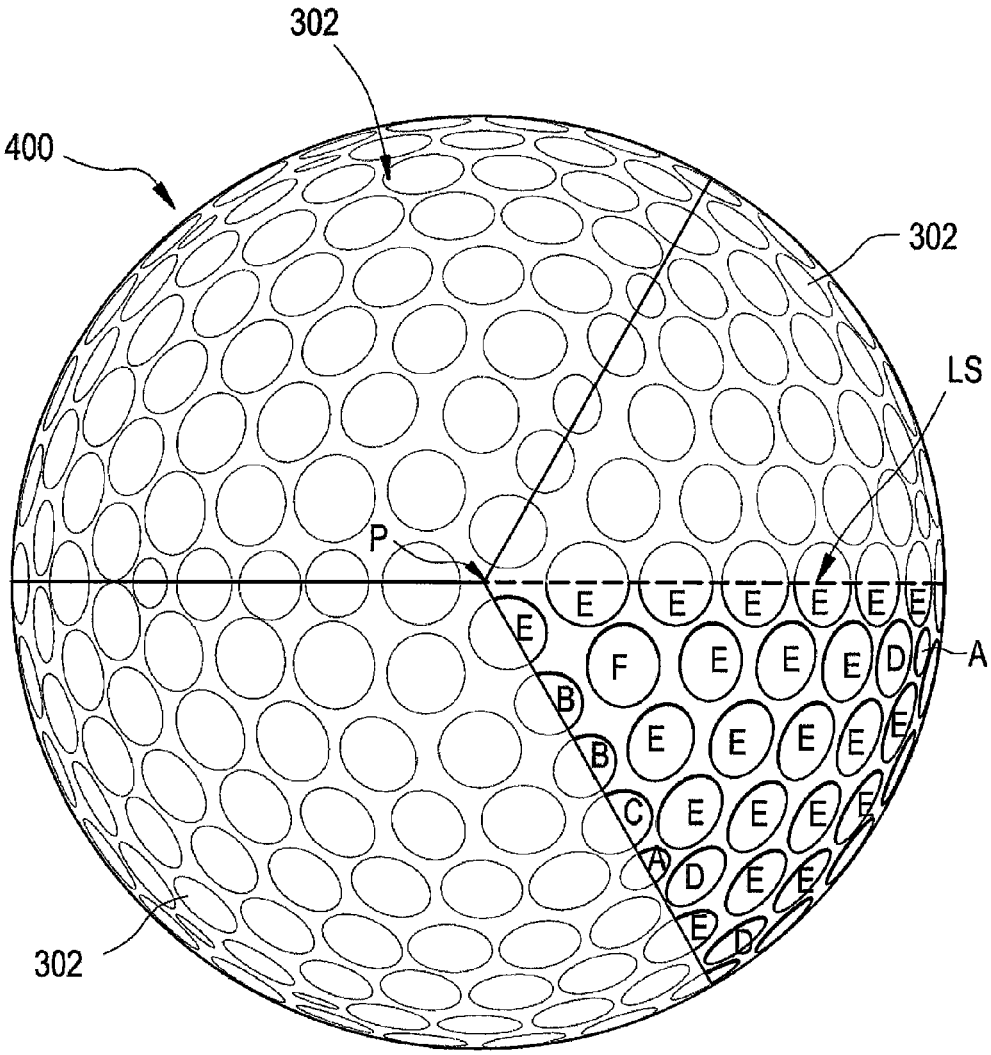
FIGS. 4A and 4B show top and front views, respectively, of another example golf ball dimple pattern in accordance with at least some aspects of this invention.
Figure 4B:
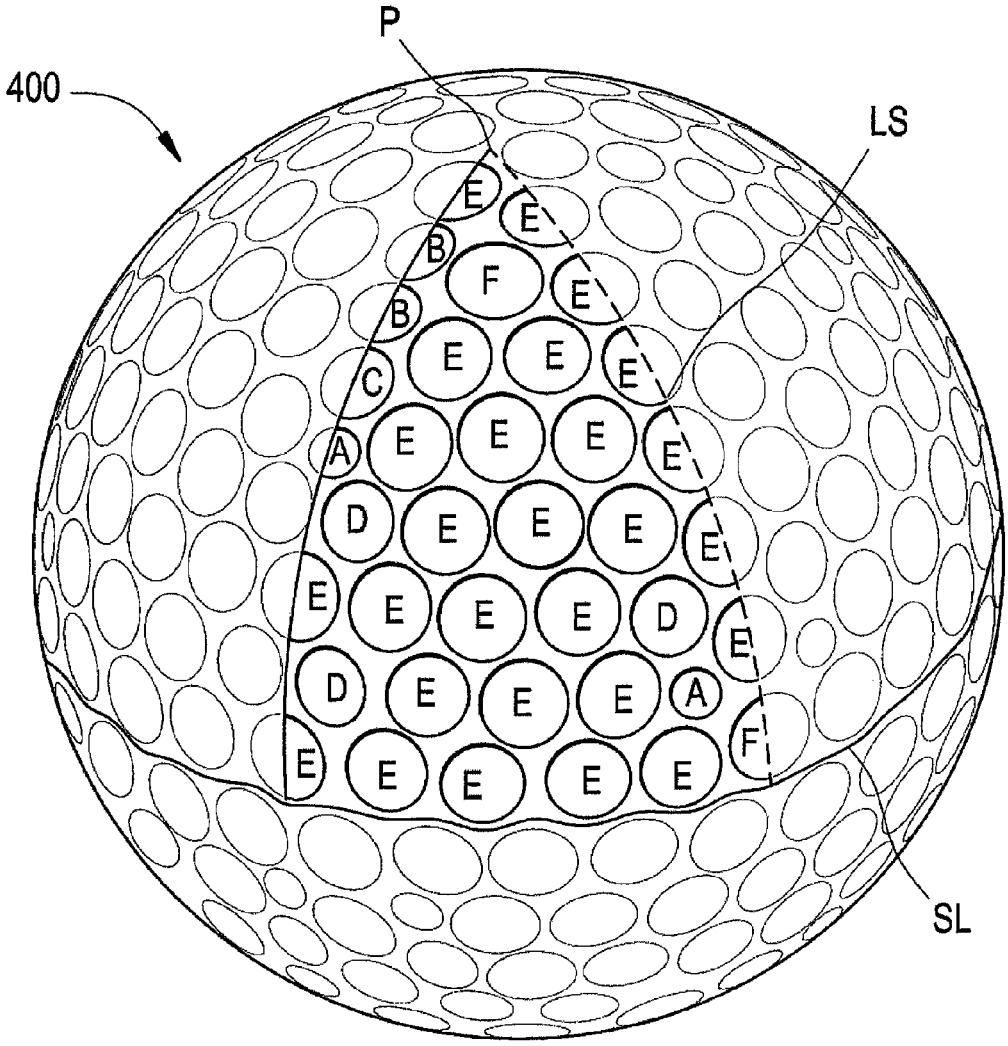

FIGS. 4A and 4B show top and front views, respectively, of another example golf ball 400 having a dimple pattern generally laid out in the manner described above with respect to FIGS. 3A and 3B, with six total dimple sectors (three sectors in each dimple pattern half) and with each sector separated by a central line of symmetry LS over which the dimples within the half sector form a mirror image of the dimples in its adjacent half sector. In this illustrated example ball 400, the dimple pattern halves are rotationally offset from one another by about 60°. This specific dimple arrangement of FIGS. 4A and 4B includes 360 total dimples, with 30 dimples per sector and 15 dimples per half sector. This ball 400 includes six different dimple types (types A through F) arranged around the ball 400.

Figure 5B:
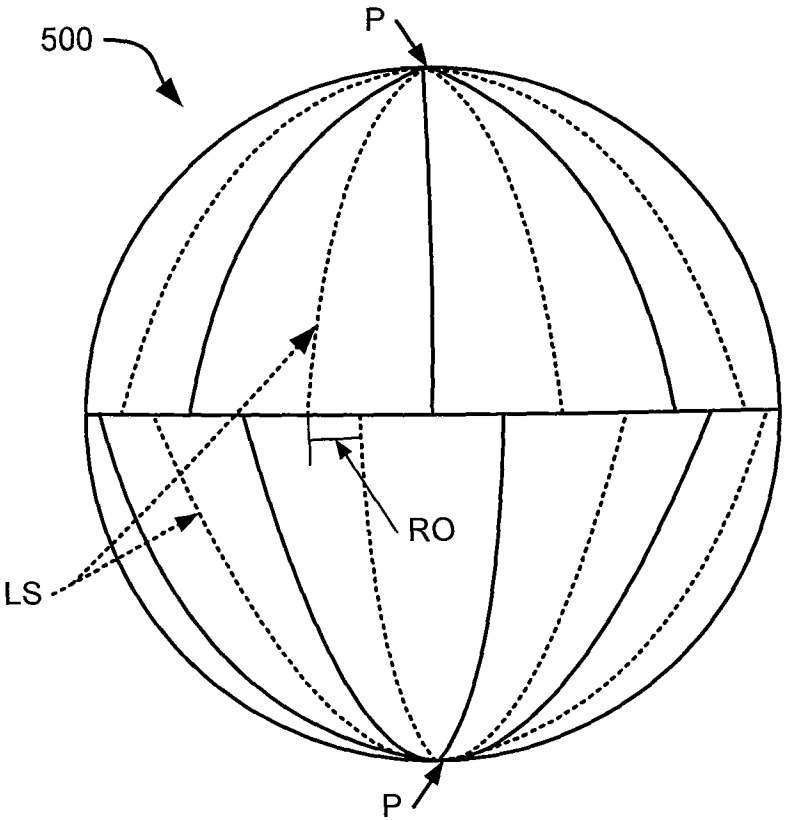
FIGS. 5A and 5B show top and front views, respectively, of an example golf ball dimple layout arrangement in accordance with at least some aspects of this invention.
Figure 5A:
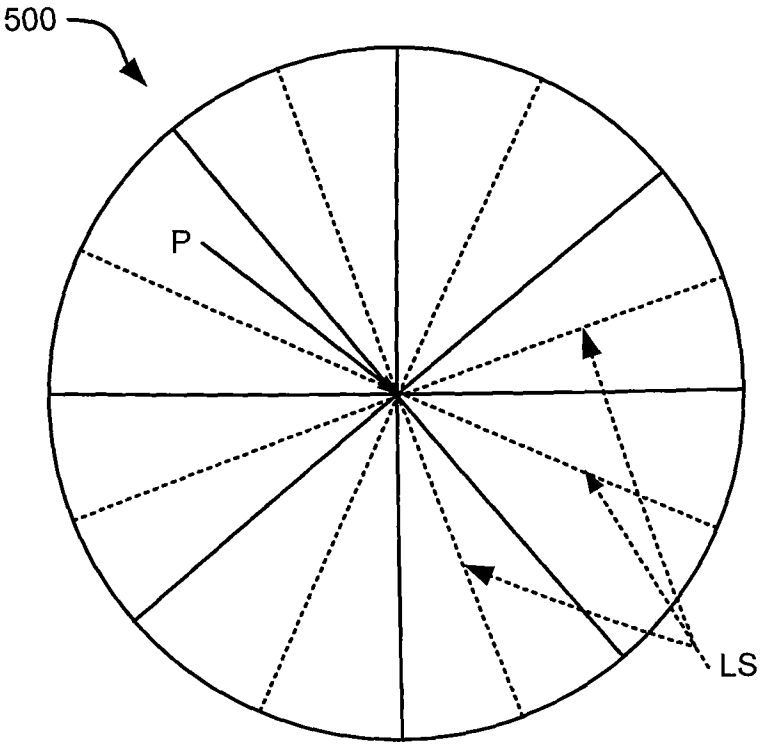

FIGS. 5A and 5B illustrate top and front views, respectively, of a golf ball 500 having each dimple pattern half broken into eight sectors (shown by the solid lines) with lines of symmetry LS (shown as broken lines in FIGS. 5A and 5B) further breaking each sector into half sectors that mirror one another over the line of symmetry LS. For clarity, no actual dimples are shown in FIGS. 5A and 5B, although any desired dimple patterns, dimple types, and/or numbers of dimples may be provided in the sectors and half sectors without departing from this invention. Furthermore, as illustrated in FIG. 5B, the top dimple pattern half may be rotationally offset from an identical bottom dimple pattern half by any desired rotational amount (a rotational offset RO of about 11.25° is shown in the specific example of FIG. 5B).

Figure 6A:
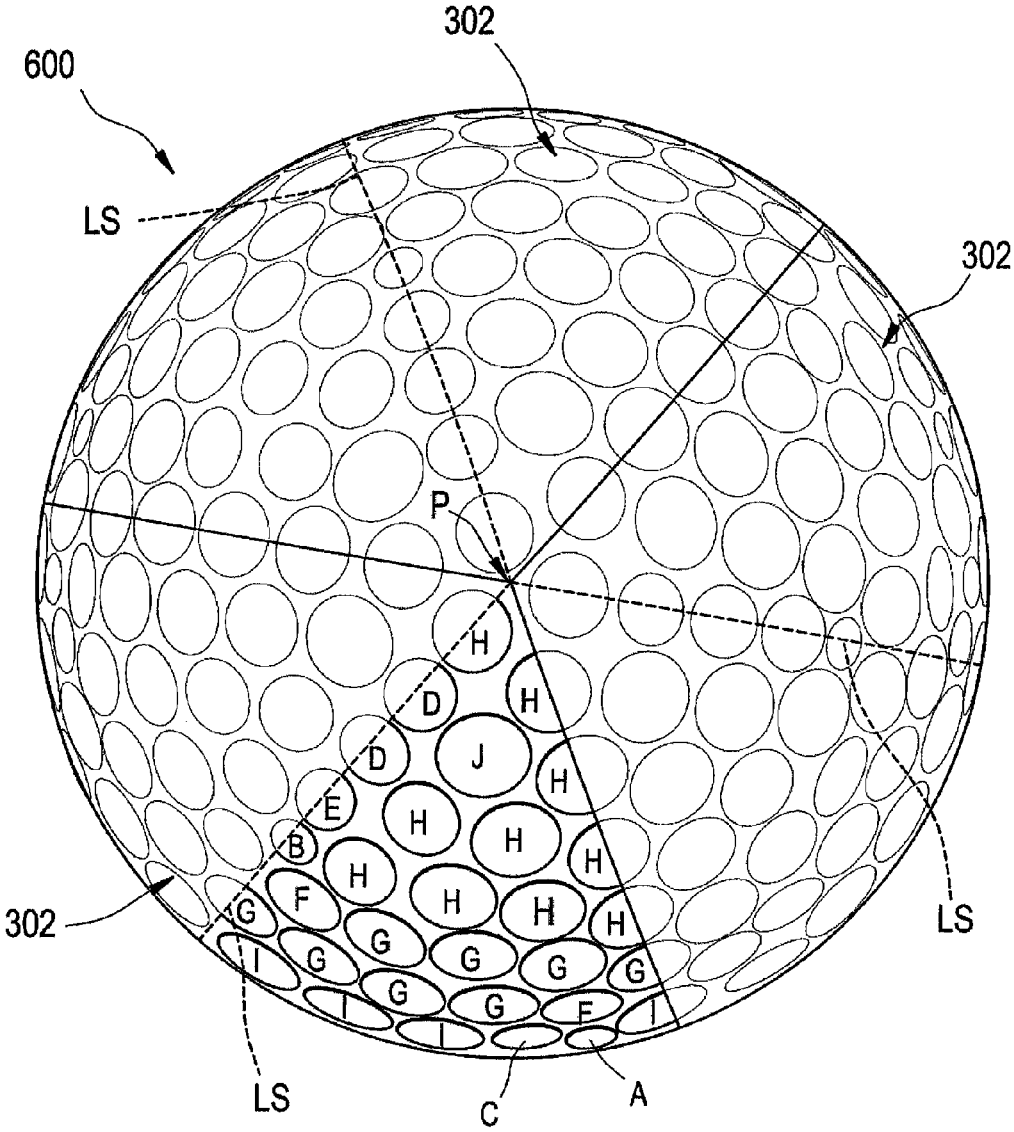
FIGS. 6A and 6B show top and front views, respectively, of another example golf ball dimple pattern in accordance with at least some aspects of this invention.
Figure 6B:
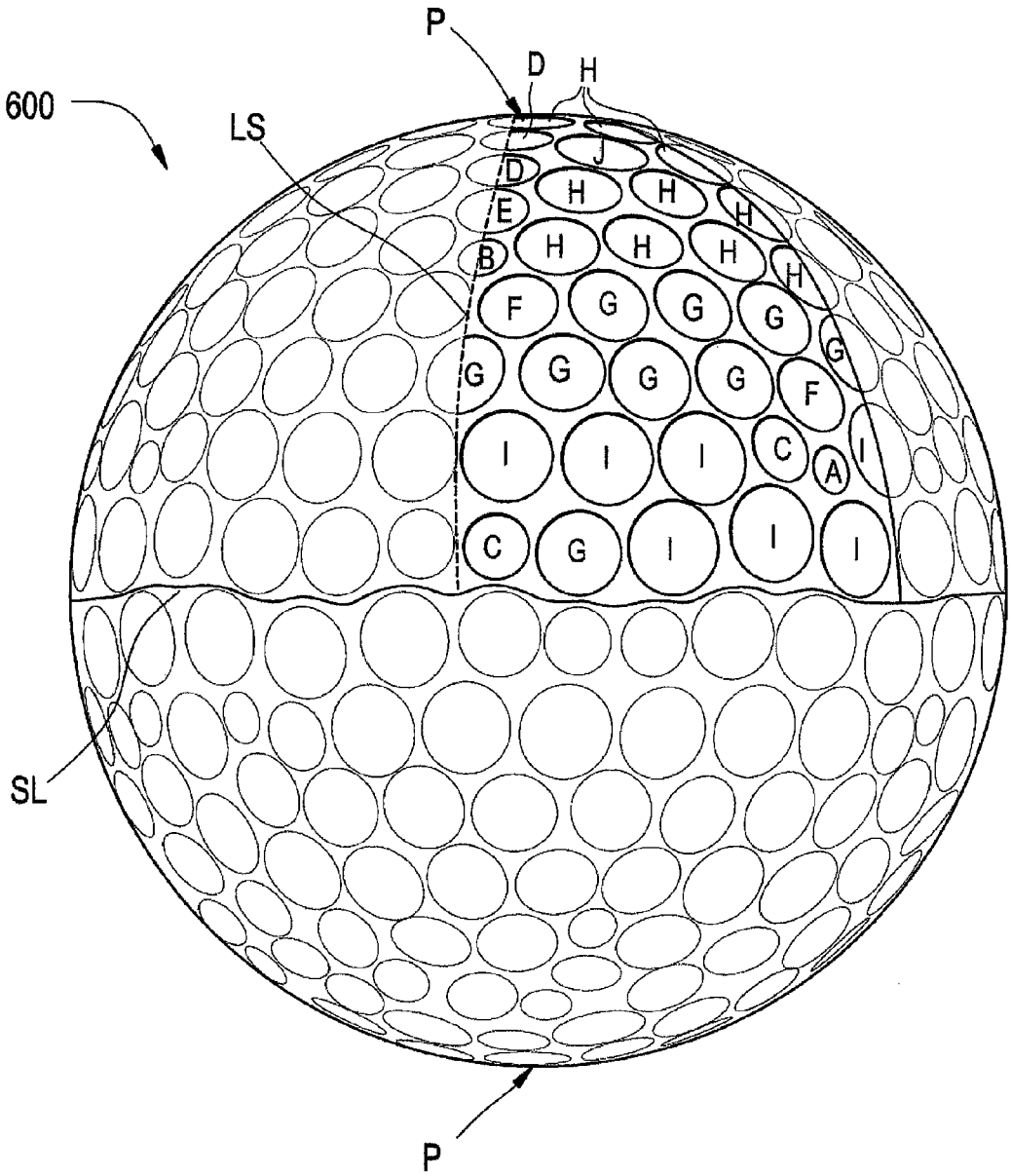

FIGS. 6A and 6B show top and front views, respectively, of another golf ball 600 having a dimple pattern generally laid out in the manner described above with respect to FIGS. 3A and 3B, with six total dimple sectors (three sectors in each dimple pattern half) and with each sector separated by a central line of symmetry LS over which the dimples within the half sector form a mirror image of the dimples in its adjacent half sector. In this illustrated example ball 600, the dimple pattern halves are rotationally offset from one another by about 10°. This specific dimple arrangement of FIGS. 6A and 6B includes 360 total dimples, with 30 dimples per sector and 15 dimples per half sector. This ball 600 includes ten different dimple types (types A through J) arranged around the ball 600.

4. Dimple Dimensional and Other Features

Additional aspects of this invention relate to the inclusion of various dimple "types" on a surface of a single golf ball. Golf balls in accordance with at least some examples of this invention may include at least four different dimple "types," and in some examples, from 4 to 20 dimple "types," from 4 to 16 dimple "types," and even from 5 to 12 dimple "types."

Dimples in accordance with examples of this invention may have a wide variety of dimensional features, cross sectional shapes, surface features, and the like. In accordance with at least some examples of this invention, dimples provided on golf ball surfaces in accordance with at least some examples of this invention may include:

(A) a dimple radius within a range of 2 to 20 mm,
(B) a dimple diameter within a range of 1.5 to 8 mm,
(C) a dimple depth within a range of 0.08 to 0.5 mm,
(D) a dimple diameter-to-depth ratio for each dimple type within a range of 8 to 40,
(E) a total dimple surface coverage area ($A_d$) with respect to the phantom ball surface area ($A_b$) of at least 65%, and
(F) a total dimple volume (flat-capped) of at least 300 $mm^3$.

Some more specific examples of characteristics and features of dimples provided on golf ball surfaces in accordance with at least some examples of this invention may include:

(A) a dimple radius within a range of 2.5 to 18 mm,
(B) a dimple diameter within a range of 2 to 6 mm,
(C) a dimple depth within a range of 0.1 to 0.3 mm,
(D) a dimple diameter-to-depth ratio for each dimple type within a range of 10 to 30,
(E) a total dimple surface coverage area ($A_d$) with respect to the phantom ball surface area ($A_b$) of at least 70%, and
(F) a total dimple volume (flat-capped) of at least 320 $mm^3$.

Some even more specific examples of characteristics and features of dimples provided on golf ball surfaces in accordance with at least some examples of this invention may include:

(A) a dimple radius within a range of 3 to 16 mm,
(B) a dimple diameter within a range of 2.2 to 5 mm,
(C) a dimple depth within a range of 0.1 to 0.25 mm,
(D) a dimple diameter-to-depth ratio for each dimple type within a range of 10 to 28,
(E) a total dimple surface coverage area ($A_d$) with respect to the phantom ball surface area ($A_b$) of 72% to 78%, and
(F) a total dimple volume (flat-capped) of at least 360 to 560 $mm^3$, and in some examples, within a range from 360 to 480 $mm^3$.

One specific dimple pattern in accordance with at least some aspects of this invention includes the general dimple arrangement shown in FIGS. 3A and 3B with 390 total dimples arranged in six total sectors and five different dimple types (types A through E). After formation of the dimples (and prior to any finishing steps), the dimples of this specific ball may have the features and characteristics as described in the table below:

TABLE 3

| Dimple Type | No. of Dimples of this Type | Radius (mm)* | Diameter (mm)* | Depth (mm)* | Diameter/ Depth Ratio |
|---|---|---|---|---|---|
| A | 36 | 3.70 | 2.40 | 0.20 | 12.00 |
| B | 24 | 9.79 | 3.30 | 0.14 | 23.57 |
| C | 54 | 8.60 | 3.50 | 0.18 | 19.44 |
| D | 30 | 9.10 | 3.70 | 0.19 | 19.47 |
| E | 246 | 12.58 | 4.00 | 0.16 | 25.00 |
| | Average | 10.77 | 3.72 | 0.17 | 22.52 |

*All dimple dimensions as described herein are based on CAD dimensions for the dimples and/or for the mold used in making the dimples and should generally correspond to the dimple dimensions as measurable on the ball after the dimples are formed, cured, and removed from the mold (or other formation apparatus), but before paint, clear coats, or other finish materials are applied to the ball. Post formation finishing processes, such as buffing, polishing, painting, clear coating, and the like, may slightly change the dimple dimensions somewhat.

The total dimple ("flat-capped") volume of this ball is 356.4 $mm^3$, and the $A_d/A_b$ ratio is about 75%.

Another specific dimple pattern in accordance with at least some aspects of this invention includes the general dimple arrangement shown in FIGS. 4A and 4B with 360 total dimples arranged in six total sectors and six different dimple types (types A through F). After formation of the dimples (and prior to any finishing steps), the dimples of this specific ball may have the features and characteristics as described in the table below:

TABLE 4

| Dimple Type | No. of Dimples of this Type | Radius (mm) | Diameter (mm) | Depth (mm) | Diameter/ Depth Ratio |
|---|---|---|---|---|---|
| A | 18 | 3.61 | 2.40 | 0.205 | 11.71 |
| B | 12 | 7.87 | 3.30 | 0.175 | 18.86 |
| C | 6 | 8.37 | 3.50 | 0.185 | 18.92 |
| D | 36 | 8.87 | 3.70 | 0.195 | 18.97 |
| E | 270 | 12.20 | 4.00 | 0.165 | 24.24 |
| F | 18 | 10.16 | 4.30 | 0.230 | 18.70 |
| | Average | 11.13 | 3.87 | 0.174 | 22.54 |

The total dimple ("flat-capped") volume of this ball is 371.4 $mm^3$, and the $A_d/A_b$ ratio is about 76%.

Another variation on the specific dimple pattern described in the table above (including the general dimple arrangement shown in FIGS. 4A and 4B with 360 total dimples arranged in six total sectors and seven different dimple types) has the following features and characteristics (after formation of the dimples and prior to any finishing steps):

TABLE 5

| No. of Dimples of this Type | Radius (mm) | Diameter (mm) | Depth (mm) | Diameter/Depth Ratio |
|---|---|---|---|---|
| 18 | 3.61 | 2.40 | 0.205 | 11.71 |
| 12 | 7.45 | 3.30 | 0.185 | 17.84 |
| 6 | 8.37 | 3.50 | 0.185 | 18.92 |
| 36 | 8.87 | 3.70 | 0.195 | 18.97 |
| 18 | 11.52 | 4.00 | 0.175 | 22.86 |
| 252 | 12.20 | 4.00 | 0.165 | 24.24 |
| 18 | 9.75 | 4.30 | 0.240 | 17.92 |
| Average | 11.13 | 3.87 | 0.174 | 22.40 |

The total dimple ("flat-capped") volume of this ball is 374.4 $mm^3$, and the $A_d/A_b$ ratio is about 76%. Notably, this ball includes two different dimple "types" having a 4 mm diameter (namely, one dimple type having a depth of 0.175 mm and the other dimple type having a depth of 0.165). The centers of a majority of the 4 mm dimples having the deeper depth (0.175 mm) are located further from the ball's seam or equator than the centers of a majority of the 4 mm dimples having the shallower depth (0.165 mm). If desired, all of the 4 mm dimples having the deeper depth will have their centers further from the seam or equator (and closer to the corresponding pole of that dimple pattern half) than the centers of the 4 mm dimples having the shallower depth.

Another specific dimple pattern in accordance with at least some aspects of this invention includes the general dimple arrangement shown in FIGS. 6A and 6B with 360 total dimples arranged in six total sectors and ten different dimple types (types A through J). After formation of the dimples (and prior to any finishing steps), the dimples of this specific ball may have the features and characteristics as described in the table below:

TABLE 6

| Dimple Type | No. of Dimples of this Type | Radius (mm) | Diameter (mm) | Depth (mm) | Diameter/ Depth Ratio |
|---|---|---|---|---|---|
| A | 12 | 3.790 | 2.4 | 0.195 | 12.31 |
| B | 6 | 3.615 | 2.4 | 0.205 | 11.71 |

TABLE 6-continued

| Dimple Type | No. of Dimples of this Type | Radius (mm) | Diameter (mm) | Depth (mm) | Diameter/ Depth Ratio |
|---|---|---|---|---|---|
| C | 24 | 10.151 | 3.3 | 0.135 | 24.44 |
| D | 12 | 9.460 | 3.3 | 0.145 | 22.76 |
| E | 6 | 8.370 | 3.5 | 0.185 | 18.92 |
| F | 24 | 9.343 | 3.7 | 0.185 | 20.00 |
| G | 96 | 12.981 | 4.0 | 0.155 | 25.81 |
| H | 90 | 12.204 | 4.0 | 0.165 | 24.24 |
| I | 78 | 11.377 | 4.3 | 0.205 | 20.98 |
| J | 12 | 10.857 | 4.3 | 0.215 | 20.00 |
| | Average | 11.281 | 3.897 | 0.173 | 22.80 |

The total dimple ("flat-capped") volume of this ball is 381.25 $mm^3$, and the $A_d/A_b$ ratio is about 76.6%.

Notably, this example ball includes a plurality of dimples including:

(a) a first dimple type having a first diameter (2.4 mm);

(b) a second dimple type having the first diameter (2.4 mm) and a deeper depth than the first dimple type (0.205 mm v. 0.195 mm), wherein a majority of dimples of the second dimple type (all of the dimples, in this example) are located further from the seam than a majority of dimples of the first dimple type (the distance from the seam is measured as the most direct path along the ball's surface from the seam line to the dimple's center);

(c) a third dimple type having a second diameter (3.3 mm) that is larger than the first diameter;

(d) a fourth dimple type having the second diameter (3.3 mm) and a deeper depth than the third dimple type (0.145 mm v. 0.135 mm), wherein a majority of dimples of the fourth dimple type (all of the dimples, in this example) are located further from the seam than a majority of dimples of the third dimple type;

(e) a fifth dimple type having a third diameter (3.5 mm) that is larger than the second diameter;

(f) a sixth dimple type having a fourth diameter (3.7 mm) that is larger than the third diameter;

(g) a seventh dimple type having a fifth diameter (4.0 mm) that is larger than the fourth diameter;

(h) an eighth dimple type having the fifth diameter (4.0 mm) and a deeper depth than the seventh dimple type (0.165 mm v. 0.155 mm), wherein a majority of dimples of the eighth dimple type (all of the dimples in this example) are located further from the seam than a majority of dimples of the seventh dimple type;

(i) a ninth dimple type having a sixth diameter (4.3 mm) that is larger than the fifth diameter; and (j) a tenth dimple type having the sixth diameter (4.3 mm) and a deeper depth than the ninth dimple type (0.215 mm v. 0.205 mm), wherein a majority of dimples of the tenth dimple type (all of the dimples in this example) are located further from the seam than a majority of dimples of the ninth dimple type.

As noted above, some dimple types will share a common dimple diameter but different dimple depths (as compared with another dimple type). In accordance with at least some examples of this invention, the deeper dimple type having the same diameter as another dimple type will have their centers placed at locations further from the seam than the centers of the shallower dimple type of that same diameter. In at least some examples, each set of deeper dimple types having the same diameter as another dimple type will have their centers located further from the seam than the centers of the shallower dimple type of that same diameter.

While certain specific dimple diameters are mentioned in Table 6 and the description immediately above, variations on these specific dimensions are possible without departing from this invention. For example, the "first diameter" noted above may be within a range of 2 to 3 mm; the "second diameter" noted above may be within a range of 3 to 3.6 mm; the "third diameter" noted above may be within a range of 3.2 to 3.8 mm; the "fourth diameter" noted above may be within a range of 3.4 to 4 mm; the "fifth diameter" noted above may be within a range of 3.6 to 4.4 mm; and the "sixth diameter" noted above may be within a range of 4 to 6 mm. The overall dimple volume (flat-capped) may be at least 320 $mm^3$, and in some examples, at least 360 $mm^3$, and in some examples within a range of 360 $mm^3$ to 560 $mm^3$ or even the range of 360 $mm^3$ to 480 $mm^3$. The $A_d/A_b$ ratio may be at least 65%, at least 70%, and in some examples, within a range of 72% to 78%.

The specific dimple pattern and arrangement described above with respect to FIGS. 6A and 6B also include various combinations of dimple sizes, but the specific dimensions may vary without departing from this invention. For example, the "first dimple type" described above may have a depth of at least 0.175 mm, and the "second dimple type" may have a depth of at least 0.185 mm. As another example feature, the "first dimple type" may have a diameter-to-depth ratio of 15 or less and the "second dimple type" may have a diameter-to-depth ratio of 14 or less. As another potential feature in at least some example dimple arrangements in accordance with this invention, each of the first and second dimple types will have a diameter-to-depth ratio of 14 or less, while each of the third through tenth dimple types may have a diameter-to-depth ratio of 16 or more (and in some instances, at least some of the third through tenth dimple types will have a diameter-to-depth ratio of 20 or more). As still another potential feature, each of the first and second dimple types described above may have a dimple radius of 5 mm or less, and optionally, each of the third through tenth dimple types may have a dimple radius of 8 mm or more (and in some instances, at least some of the third through tenth dimple types have a dimple radius of 10 mm or more). Other dimensional variations and combinations of properties also are possible without departing from this invention.

The various dimple arrangements described above may be used in any desired types of ball constructions without departing from this invention, including any of the various specific ball constructions (e.g., multi-piece ball constructions) described above.

5. Ball Production Features

Golf balls in accordance with this invention may be made in any desired manner, including in conventional manners as are known and used in the art. This includes the actual production and assembly of the various parts of a ball (such as a multi-piece ball) and inclusion of the dimples on the cover layer of the ball. Some more specific examples of various process steps follow.

As a first step in a production method for a multi-piece golf ball (e.g., a four-piece ball), a solid inner core member is provided, e.g., made of any of the various materials described above. This may be accomplished, for example, by compression molding a previously extruded core material blank into a round (or other desired) shape or by an injection molding process, e.g., such that the solid inner core has a diameter within a range of 18 to 36 mm (and in some examples from 20 to 29 mm). Once molded, the core may be cured (if necessary), smoothed, buffed, or otherwise treated.

This core then may be placed into a molding machine (e.g., supported on pins), and an outer core layer may be formed to surround the solid inner core, e.g., by an injection molding process (the supporting pins may be removed or retracted once the injection molding process has progressed a sufficient amount). Alternatively, a compression molding or casting process may be used to form a layer around the solid core. Once molded or otherwise formed, this two layer core may be cured (if necessary), smoothed, buffed, or otherwise treated. The outer core layer may have a thickness in the range of 4 to 10 mm. If necessary or desired, the outer surface of the inner core may be treated prior to the molding process so that the outer core material will maintain a stable relationship with it. Alternatively, the molding conditions and/or the materials may be selected so that the desired adherence or other relationship between these materials may be produced without the need for additional additives or surface treatments to the inner core.

Then, the two layer core may be placed into a further mold to allow a mantle layer to be formed around the outer core. This also may be accomplished, for example, by injection molding (e.g., by placing the two-layered cores within a mold supported by pins that are removed or retracted once injection molding has adequately progressed). Other formation methods also are possible (and if desired, the mantle layer may be added to the ball construction in a single step with the outer core layer, e.g., by applying both layers as a two-layered laminate around the inner core and then molding). Once molded or otherwise formed, this three layered structure may be cured (if necessary), smoothed, buffed, or otherwise treated. The mantle layer may be formed to have a thickness, e.g., within a range of 0.4 to 1.6 mm. If necessary or desired, the outer surface of the outer core may be treated prior to the molding process so that the mantle layer material will maintain a stable relationship with it. Alternatively, the molding conditions and/or the materials may be selected so that the desired relationship between these materials may be produced without the need for additional additives or surface treatments to the outer core.

Then, a cover layer may be formed to surround the mantle layer. This step also may be accomplished by an injection molding process, e.g., in the general manners described above, by a casting process, etc. The cover layer mold's interior surfaces may include projections thereon in appropriate arrangements and sizes to produce the desired dimple patterns, e.g., such as the dimple arrangements and patterns described above. Once molded, this dimpled ball structure may be cured (if necessary), smoothed, buffed, polished, or otherwise treated. The cover layer may be formed to have a nominal thickness, e.g., within a range of 0.6 to 1.6 mm. If necessary or desired, the outer surface of the mantle layer may be treated prior to the molding process so that the cover layer material will maintain a stable relationship with it. Alternatively, the molding conditions and/or the materials may be selected so that the desired relationship between these materials may be produced without the need for additional additives or surface treatments to the mantle layer.

Any of the above noted layers may include additives or other materials to allow control of various properties of the layer, such as hardness, specific gravity, compression, moment of inertia, weighting, weight distribution, etc. Also, additional layers may be added to the ball construction or layers may be taken out (such as the outer core layer) without departing from this invention.

Finally, one or more finish materials may be applied to the cover layer to thereby produce a "finished" golf ball. Such finish materials include, for example, paints, clear coats (e.g., protective coatings for scratch and scuff resistance), optical brighteners, anti-yellowing agents, hydrophobic agents, colorants, pigments, etc.

Finished balls in accordance with at least some examples of this invention may include various properties, such as the hardness properties described above. As some more specific examples for a four-piece ball: (a) the solid inner core of the finished golf ball may have a surface hardness within a range of 42 to 54 Shore D (and in some examples, from 45 to 51 Shore D), (b) the outer core layer of the finished golf ball may have a surface hardness within a range of 50 to 64 Shore D (and in some examples, from 54 to 60 Shore D), (c) the mantle layer of the finished golf ball may have a surface hardness within a range of 60 to 72 Shore D (and in some examples, within a range of 64 to 70 Shore D), (d) the cover layer of the finished golf ball may have a surface hardness within a range of 44 to 60 Shore D (and in some examples, from 51 to 57 Shore D), and (e) the Shore D hardness of the mantle layer may be higher than the Shore D surface hardnesses of the solid inner core, the outer core layer, and the cover layer. In some example constructions in accordance with this invention, in the finished golf ball, the surface hardness of the mantle layer will be at least 8 Shore D points higher than the surface hardness of the outer core layer, at least 16 Shore D points higher than the surface hardness of the solid inner core, and at least 10 Shore D points higher than the surface hardness of the cover layer.

In some even more specific ball structures in accordance with this invention, in the finished golf ball product: (a) the surface hardness of the solid inner core will be within a range of 46 to 50 Shore D and the diameter of the solid inner core will be within a range of 23 to 26 mm; (b) the surface hardness of the outer core layer will be within a range of 55 to 59 Shore D and the thickness of the outer core layer will be within a range of 6 to 8 mm; (c) the surface hardness of the mantle layer will be within a range of 65 to 69 Shore D and the thickness of the mantle layer will be within a range of 0.8 to 1.2 mm; and (d) the surface hardness of the cover layer will be within a range of 52 to 56 Shore D and the nominal thickness of the cover layer will be within a range of 0.9 to 1.3 mm.

Alternative example methods and constructions of golf balls according to this invention may include: providing a core made from one or more pieces, wherein the core has a diameter within a range of 18 to 40 mm; (b) forming a mantle layer immediately adjacent to and surrounding an outermost surface of the core, the mantle layer including a thermoplastic polyurethane containing material, wherein the mantle layer has a thickness within a range of 0.4 to 1.6 mm; (c) forming a cover layer to surround the mantle layer, the cover layer including a thermoplastic polyurethane containing material, wherein the cover layer has a nominal thickness within a range of 0.6 to 1.6 mm, wherein the cover layer is formed to include a plurality of dimples therein (e.g., in any desired pattern or arrangement, including the patterns and arrangements described above); and (d) applying a finish material over the cover layer to thereby produce a "finished" golf ball. These steps may be the same as or similar to those described above, and may include conventional methods steps as are known and used in the art. The core of this finished golf ball may have an outermost surface hardness within a range of 53 to 61 Shore D, the mantle layer of this finished golf ball may have a surface hardness within a range of 64 to 72 Shore D, the cover layer of this finished golf ball may have a surface hardness within a range of 50 to 58 Shore D, and the Shore D hardness of the mantle layer may be made higher than the Shore D outermost surface hardness of the core and the Shore D surface hardness of the cover layer. As some more specific examples, in the finished golf ball, the surface hardness of the mantle layer may be at least 8 Shore D points higher than the outermost surface hardness of the core and at least 10 Shore D points higher than the surface hardness of the cover layer.

CONCLUSION

Of course, many modifications to the golf balls and/or methods for making these balls may be used without departing from the invention. For example, the sizes, shapes, and other features of the dimples and their arrangements may vary widely, at least in some aspects of this invention. Also, the material properties of the ball construction, such as the construction type (e.g., core type), layer materials, layer hardnesses, layer compressions, layer thicknesses, and the like also may vary widely, at least in some aspects of this invention. With respect to the methods, additional production steps may be added, various described steps may be omitted, the steps may be changed and/or changed in order, and the like, without departing from the invention. Therefore, while the invention has been described with respect to specific examples including presently preferred modes of carrying out the invention, those skilled in the art will appreciate that there are numerous variations and permutations of the above described structures and methods. Thus, the spirit and scope of the invention should be construed broadly as set forth in the appended claims.

We claim:

1. A golf ball including a first pole, a second pole, and a seam located between the first and second poles, the golf ball including a surface having a plurality of dimples formed therein, wherein the dimples include:

a first dimple type having a first diameter;

a second dimple type having the first diameter, wherein the second dimple type is deeper than the first dimple type, and wherein a majority of dimples of the second dimple type are located further from the seam than a majority of dimples of the first dimple type;

a third dimple type having a second diameter that is larger than the first diameter;

a fourth dimple type having the second diameter, wherein the fourth dimple type is deeper than the third dimple type, and wherein a majority of dimples of the fourth dimple type are located further from the seam than a majority of dimples of the third dimple type;

a fifth dimple type having a third diameter that is larger than the second diameter;

a sixth dimple type having a fourth diameter that is larger than the third diameter;

a seventh dimple type having a fifth diameter that is larger than the fourth diameter;

an eighth dimple type having the fifth diameter, wherein the eighth dimple type is deeper than the seventh dimple type, and wherein a majority of dimples of the eighth dimple type are located further from the seam than a majority of dimples of the seventh dimple type;

a ninth dimple type having a sixth diameter that is larger than the fifth diameter; and a tenth dimple type having the sixth diameter, wherein the tenth dimple type is deeper than the ninth dimple type, and wherein a majority of dimples of the tenth dimple type are located further from the seam than a majority of dimples of the ninth dimple type.

2. A golf ball according to claim 1, wherein:

all of the dimples of the second dimple type are located further from the seam than all of the dimples of the first dimple type;

all of the dimples of the fourth dimple type are located further from the seam than all of the dimples of the third dimple type;

all of the dimples of the eighth dimple type are located further from the seam than all of the dimples of the seventh dimple type; and all of the dimples of the tenth dimple type are located further from the seam than all of the dimples of the ninth dimple type.

3. A golf ball according to claim 1, wherein:

the first diameter is within a range of 2 to 3 mm;

the second diameter is within a range of 3 to 3.6 mm;

the third diameter is within a range of 3.2 to 3.8 mm;

the fourth diameter is within a range of 3.4 to 4 mm;

the fifth diameter is within a range of 3.6 to 4.4 mm; and the sixth diameter is within a range of 4 to 6 mm.

4. A golf ball according to claim 3, wherein the surface includes:

12 dimples of the first dimple type;

6 dimples of the second dimple type;

24 dimples of the third dimple type;

12 dimples of the fourth dimple type;

6 dimples of the fifth dimple type;

24 dimples of the sixth dimple type;

96 dimples of the seventh dimple type;

90 dimples of the eighth dimple type;

78 dimples of the ninth dimple type; and 12 dimples of the tenth dimple type.

5. A golf ball according to claim 1, wherein the golf ball has a ratio $A_d/A_b$ of at least 70%, wherein $A_d$ is a total dimple surface coverage area as determined by Formula (I):

$$A_d = \sum_{n=1}^{M} \pi \times (d_n/2)^2, \qquad \text{Formula (I)}$$

wherein "M" is a total number of dimples on the golf ball, and "d" is an individual dimple diameter, and wherein $A_b$ is a total golf ball surface area assuming no dimples are present on the ball as determined by Formula (II):

$$A_b = 4\pi \times (D/2)^2 \qquad \text{Formula (II)},$$

wherein "D" is an outermost diameter of the golf ball.

6. A golf ball according to claim 5, wherein the $A_d/A_b$ ratio is within a range of 72% to 78%.

7. A golf ball according to claim 1, wherein a total number of dimples is in a range from 330 to 392.

8. A golf ball according to claim 1, wherein the surface includes:

at least 12 dimples of the first dimple type;

at least 6 dimples of the second dimple type;

at least 24 dimples of the third dimple type;

at least 12 dimples of the fourth dimple type;

at least 6 dimples of the fifth dimple type;

at least 24 dimples of the sixth dimple type;

at least 96 dimples of the seventh dimple type;

at least 90 dimples of the eighth dimple type;

at least 78 dimples of the ninth dimple type; and at least 12 dimples of the tenth dimple type.

9. A golf ball according to claim 1, wherein the first dimple type has a depth of at least 0.175 mm and the second dimple type has a depth of at least 0.185 mm, wherein each of the first and second dimple types has a diameter-to-depth ratio of 14 or less, and wherein each of the third through tenth dimple types has a diameter-to-depth ratio of 16 or more.

10. A golf ball according to claim 1, wherein the first dimple type has a depth of at least 0.175 mm and the second dimple type has a depth of at least 0.185 mm.

11. A golf ball according to claim 1, wherein the first dimple type has a diameter-to-depth ratio of 15 or less and the second dimple type has a diameter-to-depth ratio of 14 or less, wherein each of the third through tenth dimple types has a diameter-to-depth ratio of 16 or more, and wherein an overall dimple volume on the surface of the golf ball is within a range from 360 $mm^3$ to 480 $mm^3$.

12. A golf ball according to claim 1, wherein the first dimple type has a diameter-to-depth ratio of 15 or less and the second dimple type has a diameter-to-depth ratio of 14 or less.

13. A golf ball according to claim 1, wherein each of the first and second dimple types has a diameter-to-depth ratio of 14 or less, and wherein each of the third through tenth dimple types has a diameter-to-depth ratio of 16 or more.

14. A golf ball according to claim 13, wherein at least some of the third through tenth dimple types have a diameter-to-depth ratio of 20 or more.

15. A golf ball according to claim 1, wherein each of the first and second dimple types has a dimple radius of 5 mm or less.

16. A golf ball according to claim 15, wherein each of the third through tenth dimple types has a dimple radius of 8 mm or more.

17. A golf ball according to claim 1, wherein the first dimple type has a depth of at least 0.175 mm and the second dimple type has a depth of at least 0.185 mm, and wherein an overall dimple volume on the surface of the golf ball is within a range from 360 $mm^3$ to 480 $mm^3$.

18. A golf ball including a first pole, a second pole, and a seam located between the first and second poles, the golf ball including a surface having a plurality of dimples formed therein, wherein the plurality of dimples are arranged in a pattern that includes:

(a) a first dimple pattern half including N sectors, wherein N is an integer ranging from 2 to 10, wherein a first dimple pattern sector is arranged in each of the N sectors of the first dimple pattern half such that a line of symmetry extending in a direction from the first pole to the seam exists within each of the N sectors of the first dimple pattern half, and wherein the first dimple pattern sector is repeated N times around the first pole, and (b) a second dimple pattern half including N sectors, wherein the first dimple pattern sector is arranged in each of the N sectors of the second dimple pattern half such that a line of symmetry extending in a direction from the second pole to the seam exists within each of the N sectors of the second dimple pattern half, wherein the first dimple pattern sector is repeated N times around the second pole, and wherein the lines of symmetry in the first dimple pattern half do not align with and are rotationally offset from the lines of symmetry of the second dimple pattern half by an offset amount within a range of 2° to (360/2N)° , wherein the plurality of dimples further includes:

a first dimple type having a first diameter;

a second dimple type having the first diameter, wherein the second dimple type is deeper than the first dimple type, and wherein a majority of dimples of the second dimple type are located further from the seam than a majority of dimples of the first dimple type;

a third dimple type having a second diameter that is larger than the first diameter;

a fourth dimple type having the second diameter, wherein the fourth dimple type is deeper than the third dimple type, and wherein a majority of dimples of the fourth dimple type are located further from the seam than a majority of dimples of the third dimple type;

a fifth dimple type having a third diameter that is larger than the second diameter;

a sixth dimple type having a fourth diameter that is larger than the third diameter;

a seventh dimple type having a fifth diameter that is larger than the fourth diameter;

an eighth dimple type having the fifth diameter, wherein the eighth dimple type is deeper than the seventh dimple type, and wherein a majority of dimples of the eighth dimple type are located further from the seam than a majority of dimples of the seventh dimple type;

a ninth dimple type having a sixth diameter that is larger than the fifth diameter; and a tenth dimple type having the sixth diameter, wherein the tenth dimple type is deeper than the ninth dimple type, and wherein a majority of dimples of the tenth dimple type are located further from the seam than a majority of dimples of the ninth dimple type.

19. A golf ball according to claim 18, wherein N is an integer ranging from 2 to 8.

20. A golf ball according to claim 18, wherein a total number of dimples on the surface is in a range from 320 to 432.

21. A golf ball according to claim 18, wherein:

all of the dimples of the second dimple type are located further from the seam than all of the dimples of the first dimple type;

all of the dimples of the fourth dimple type are located further from the seam than all of the dimples of the third dimple type;

all of the dimples of the eighth dimple type are located further from the seam than all of the dimples of the seventh dimple type; and all of the dimples of the tenth dimple type are located further from the seam than all of the dimples of the ninth dimple type.

22. A golf ball according to claim 18, wherein:

the first diameter is within a range of 2 to 3 mm;

the second diameter is within a range of 3 to 3.6 mm;

the third diameter is within a range of 3.2 to 3.8 mm;

the fourth diameter is within a range of 3.4 to 4 mm;

the fifth diameter is within a range of 3.6 to 4.4 mm; and the sixth diameter is within a range of 4 to 6 mm.

23. A golf ball according to claim 22, wherein the surface includes:

12 dimples of the first dimple type;

6 dimples of the second dimple type;

24 dimples of the third dimple type;

12 dimples of the fourth dimple type;

6 dimples of the fifth dimple type;

24 dimples of the sixth dimple type;

96 dimples of the seventh dimple type;

90 dimples of the eighth dimple type;

78 dimples of the ninth dimple type; and 12 dimples of the tenth dimple type.

24. A golf ball according to claim 18, wherein the golf ball has a ratio $A_d/A_b$ of at least 70%, wherein $A_d$ is a total dimple surface coverage area as determined by Formula (I):

$$A_d = \sum_{n=1}^{M} \pi \times (d_n/2)^2, \qquad \text{Formula (I)}$$

wherein "M" is a total number of dimples on the golf ball, and "d" is an individual dimple diameter, and wherein $A_b$ is a total golf ball surface area assuming no dimples are present on the ball as determined by Formula (II):

$$A_b = 4\pi \times (D/2)^2 \qquad \text{Formula (II)},$$

wherein "D" is an outermost diameter of the golf ball.

25. A golf ball according to claim 24, wherein the $A_d/A_b$ ratio is within a range of 72% to 78%.

26. A golf ball according to claim 18, wherein a total number of dimples on the surface is in a range from 330 to 392.

27. A golf ball according to claim 18, wherein the surface includes:

at least 12 dimples of the first dimple type;

at least 6 dimples of the second dimple type;

at least 24 dimples of the third dimple type;

at least 12 dimples of the fourth dimple type;

at least 6 dimples of the fifth dimple type;

at least 24 dimples of the sixth dimple type;

at least 96 dimples of the seventh dimple type;

at least 90 dimples of the eighth dimple type;

at least 78 dimples of the ninth dimple type; and at least 12 dimples of the tenth dimple type.

28. A golf ball according to claim 18, wherein the first dimple type has a depth of at least 0.175 mm and the second dimple type has a depth of at least 0.185 mm, wherein each of the first and second dimple types has a diameter-to-depth ratio of 14 or less, and wherein each of the third through tenth dimple types has a diameter-to-depth ratio of 16 or more.

29. A golf ball according to claim 18, wherein the first dimple type has a depth of at least 0.175 mm and the second dimple type has a depth of at least 0.185 mm.

30. A golf ball according to claim 18, wherein the first dimple type has a diameter-to-depth ratio of 15 or less and the second dimple type has a diameter-to-depth ratio of 14 or less, wherein each of the third through tenth dimple types has a diameter-to-depth ratio of 16 or more, and wherein an overall dimple volume on the surface of the golf ball is within a range from 360 $mm^3$ to 480 $mm^3$.

31. A golf ball according to claim 18, wherein the first dimple type has a diameter-to-depth ratio of 15 or less and the second dimple type has a diameter-to-depth ratio of 14 or less.

32. A golf ball according to claim 31, wherein each of the first and second dimple types has a diameter-to-depth ratio of 14 or less, and wherein each of the third through tenth dimple types has a diameter-to-depth ratio of 16 or more.

33. A golf ball according to claim 32, wherein at least some of the third through tenth dimple types have a diameter-to-depth ratio of 20 or more.

34. A golf ball according to claim 18, wherein each of the first and second dimple types has a dimple radius of 5 mm or less.

35. A golf ball according to claim 34, wherein each of the third through tenth dimple types has a dimple radius of 8 mm or more.

36. A golf ball according to claim 18, wherein the first dimple type has a depth of at least 0.175 mm and the second dimple type has a depth of at least 0.185 mm, and wherein an overall dimple volume on the surface of the golf ball is within a range from 360 $mm^3$ to 480 $mm^3$.

37. A method of forming a golf ball including a first pole, a second pole, and a seam located between the first and second poles, comprising:

forming a surface of the golf ball to include a plurality of dimples therein, wherein the dimples are formed to include:

a first dimple type having a first diameter;

a second dimple type having the first diameter, wherein the second dimple type is deeper than the first dimple type, and wherein a majority of dimples of the second dimple type are located further from the seam than a majority of dimples of the first dimple type;

a third dimple type having a second diameter that is larger than the first diameter;

a fourth dimple type having the second diameter, wherein the fourth dimple type is deeper than the third dimple type, and wherein a majority of dimples of the fourth dimple type are located further from the seam than a majority of dimples of the third dimple type;

a fifth dimple type having a third diameter that is larger than the second diameter;

a sixth dimple type having a fourth diameter that is larger than the third diameter;

a seventh dimple type having a fifth diameter that is larger than the fourth diameter;

an eighth dimple type having the fifth diameter, wherein the eighth dimple type is deeper than the seventh dimple type, and wherein a majority of dimples of the eighth dimple type are located further from the seam than a majority of dimples of the seventh dimple type;

a ninth dimple type having a sixth diameter that is larger than the fifth diameter; and a tenth dimple type having the sixth diameter, wherein the tenth dimple type is deeper than the ninth dimple type, and wherein a majority of dimples of the tenth dimple type are located further from the seam than a majority of dimples of the ninth dimple type.

38. A method according to claim 37, wherein the forming step includes molding.

39. A method according to claim 37, wherein the forming step includes placing a golf ball core in a mold and injection molding a cover material to surround the core and thereby form the surface with the plurality of dimples formed therein.

40. A method according to claim 37, wherein the forming step includes casting a cover material around a golf ball core to surround the core and thereby form the surface with the plurality of dimples formed therein.

41. A method of forming a golf ball including a first pole, a second pole, and a seam located between the first and second poles, comprising:

forming a surface of the golf ball to include a plurality of dimples therein, wherein the plurality of dimples are formed in a pattern that includes:

(a) a first dimple pattern half including N sectors, wherein N is an integer ranging from 2 to 10, wherein a first dimple pattern sector is arranged in each of the N sectors of the first dimple pattern half such that a line of symmetry extending in a direction from the first pole to the seam exists within each of the N sectors of the first dimple pattern half, and wherein the first dimple pattern sector is repeated N times around the first pole, and (b) a second dimple pattern half including N sectors, wherein the first dimple pattern sector is arranged in each of the N sectors of the second dimple pattern half such that a line of symmetry extending in a direction from the second pole to the seam exists within each of the N sectors of the second dimple pattern half, wherein the first dimple pattern sector is repeated N times around the second pole, and wherein the lines of symmetry in the first dimple pattern half do not align with and are rotationally offset from the lines of symmetry of the second dimple pattern half by an offset amount within a range of 2° to (360/2N)° , wherein the plurality of dimples further are formed to include:

a first dimple type having a first diameter;

a second dimple type having the first diameter, wherein the second dimple type is deeper than the first dimple type, and wherein a majority of dimples of the second dimple type are located further from the seam than a majority of dimples of the first dimple type;

a third dimple type having a second diameter that is larger than the first diameter;

a fourth dimple type having the second diameter, wherein the fourth dimple type is deeper than the third dimple type, and wherein a majority of dimples of the fourth dimple type are located further from the seam than a majority of dimples of the third dimple type;

a fifth dimple type having a third diameter that is larger than the second diameter;

a sixth dimple type having a fourth diameter that is larger than the third diameter;

a seventh dimple type having a fifth diameter that is larger than the fourth diameter;

an eighth dimple type having the fifth diameter, wherein the eighth dimple type is deeper than the seventh dimple type, and wherein a majority of dimples of the eighth dimple type are located further from the seam than a majority of dimples of the seventh dimple type;

a ninth dimple type having a sixth diameter that is larger than the fifth diameter; and a tenth dimple type having the sixth diameter, wherein the tenth dimple type is deeper than the ninth dimple type, and wherein a majority of dimples of the tenth dimple type are located further from the seam than a majority of dimples of the ninth dimple type.

42. A method according to claim 41, wherein the forming step includes molding.

43. A method according to claim 41, wherein the forming step includes placing a golf ball core in a mold and injection molding a cover material to surround the core and thereby form the surface with the plurality of dimples formed therein.

44. A method according to claim 41, wherein the forming step includes casting a cover material around a golf ball core to surround the core and thereby form the surface with the plurality of dimples formed therein.

* * * * *